US010488122B2

(12) United States Patent
Vanderwees et al.

(10) Patent No.: US 10,488,122 B2
(45) Date of Patent: Nov. 26, 2019

(54) HEAT EXCHANGERS WITH FLOATING HEADERS

(71) Applicant: Dana Canada Corporation, Oakville (CA)

(72) Inventors: Doug Vanderwees, Mississauga (CA); Manaf Hasan, Collingwood (CA); Jianan Huang, Oakville (CA); Brian E. Cheadle, Brampton (CA)

(73) Assignee: Dana Canada Corporation, Oakville (CA)

( * ) Notice: Subject to any disclaimer, the term of this patent is extended or adjusted under 35 U.S.C. 154(b) by 285 days.

(21) Appl. No.: 15/359,072

(22) Filed: Nov. 22, 2016

(65) Prior Publication Data

US 2017/0198987 A1 Jul. 13, 2017

Related U.S. Application Data

(62) Division of application No. 13/537,824, filed on Jun. 29, 2012, now Pat. No. 9,528,777.

(51) Int. Cl.
*F28F 9/02* (2006.01)
*F28D 7/10* (2006.01)
(Continued)

(52) U.S. Cl.
CPC ..... *F28F 9/0239* (2013.01); *F22B 9/04* (2013.01); *F28D 7/0066* (2013.01); *F28D 7/10* (2013.01); *F28D 7/16* (2013.01); *F28D 21/001* (2013.01); *F28F 9/0241* (2013.01); *F28F 27/00* (2013.01); *F28D 2021/0024* (2013.01);
(Continued)

(58) Field of Classification Search
CPC ..... F28D 7/0066; F28D 7/0075; F28D 7/10; F28D 7/103; F28D 7/163; F28D 21/001; F28D 2021/0024; F28D 2021/0064; F28F 9/0239; F28F 9/0241; F28F 9/04;
(Continued)

(56) References Cited

U.S. PATENT DOCUMENTS 1,572,792 A 2/1926 Guyot
2,072,975 A 3/1937 Winsborough et al.
(Continued)

FOREIGN PATENT DOCUMENTS

CN 1742187 A 3/2006
DE 102007017227 A1 10/2008
GB 1413913 A 11/1975

*Primary Examiner* — Christopher R Zerphey
*Assistant Examiner* — Hans R Weiland
(74) *Attorney, Agent, or Firm* — Marshall & Melhorn, LLC

(57) ABSTRACT

A heat exchanger is comprised of two heat exchanger sections, at least one of which is provided with a floating header to accommodate differential thermal expansion. The two heat exchanger sections are enclosed by an inner shell wall, and an external connecting passage is provided outside the inner shell wall, through which one of the fluids flows between the two heat exchanger sections. The external connecting passage is enclosed by an outer shell. The inner wall is provided with openings which communicate with the external connecting passage. The openings may be in the form of a substantially continuous gap or discrete openings. Specific examples of heat exchangers with this construction include a steam generator, a steam generator and combined catalytic converter, and a water gas shift reactor.

4 Claims, 16 Drawing Sheets

(51) Int. Cl.

| | |
|---|---|
| ***F28D 7/16*** | (2006.01) |
| ***F28F 9/22*** | (2006.01) |
| ***F28F 27/00*** | (2006.01) |
| ***F28D 21/00*** | (2006.01) |
| ***F22B 9/04*** | (2006.01) |
| ***F28D 7/00*** | (2006.01) |

(52) U.S. Cl.
CPC ..... *F28D 2021/0064* (2013.01); *F28F 2009/226* (2013.01); *F28F 2265/26* (2013.01)

(58) Field of Classification Search
CPC .. F28F 2009/226; F28F 2265/26; F28F 27/00; F22B 9/04
See application file for complete search history.

(56) References Cited

U.S. PATENT DOCUMENTS

| | | | | |
|---|---|---|---|---|
| 2,393,283 | A | 1/1946 | Boyles et al. | |
| 2,612,350 | A | 9/1952 | Stadler | |
| 3,739,443 | A * | 6/1973 | Friedman | B21D 53/06 165/159 |
| 3,776,303 | A | 12/1973 | Anderson et al. | |
| 3,997,002 | A * | 12/1976 | Baker | B64D 13/00 165/154 |
| 4,276,928 | A | 7/1981 | Blaskowski | |
| 4,427,058 | A | 1/1984 | Bell, Sr. et al. | |
| 4,440,213 | A | 4/1984 | Sarvis | |
| RE35,890 | E | 9/1998 | So | |
| 6,273,183 | B1 | 8/2001 | So et al. | |
| 6,412,547 | B1 | 7/2002 | Siler | |
| 6,474,408 | B1 | 11/2002 | Yeh et al. | |
| 7,172,737 | B2 | 2/2007 | Rong et al. | |
| 7,220,392 | B2 | 5/2007 | Rong et al. | |
| 7,240,723 | B2 | 7/2007 | Wu et al. | |
| 7,621,317 | B2 * | 11/2009 | Rousseau | F28F 9/001 165/149 |
| 2006/0051261 | A1 * | 3/2006 | Rong | B01J 8/008 422/198 |
| 2007/0261820 | A1 | 11/2007 | Rousseau et al. | |
| 2008/0245507 | A1 | 10/2008 | Agee | |
| 2009/0194266 | A1 | 8/2009 | Conrad et al. | |
| 2010/0103629 | A1 | 4/2010 | Carlson et al. | |
| 2010/0205946 | A1 * | 8/2010 | Fukudome | F01N 3/2889 60/298 |
| 2010/0282450 | A1 | 11/2010 | Mulder | |
| 2011/0192570 | A1 | 8/2011 | Agee | |
| 2012/0222845 | A1 * | 9/2012 | Kinder | F28F 13/12 165/154 |

* cited by examiner

HEAT EXCHANGERS WITH FLOATING HEADERS

FIELD OF THE INVENTION

The invention relates to heat exchangers having at least one heat exchanger section which may have a shell and tube construction, and in particular to such heat exchangers in which axial thermal expansion of the tubes is accommodated by the provision of a floating header.

BACKGROUND OF THE INVENTION

Heat exchangers are commonly used for transferring heat from a very hot gas to a relatively cool gas and/or liquid. Significant temperature differences can exist between those parts of the heat exchanger which are in contact with the hot gas and those parts which are in contact with the cooler gas and/or liquid. These temperature differences can result in differential thermal expansion of the heat exchanger components, which can cause stresses in the joints between the various components and in the components themselves. Over time, these stresses can cause premature failure of joints and/or the heat exchanger components.

In a typical shell and tube heat exchanger, a hot gas stream flowing through the tubes transfers heat to a relatively cool gas and/or liquid flowing through the shell, in contact with the outer surfaces of the tubes. The tubes are much hotter than the surrounding shell, which causes the tubes to expand axially (lengthwise) by a greater amount than the shell. This differential thermal expansion of the tubes and the shell causes potentially damaging stresses on the tube to header joints, as well as on the tubes, the headers, and the shell.

It is known to provide shell and tube heat exchangers with means which allow for differential thermal expansion of the tubes and the shell. For example, commonly assigned U.S. Pat. No. 7,220,392 (Rong et al.) describes a shell and tube fuel conversion reactor in which only one end of the tubes are rigidly connected to the shell through a header. The header at the opposite end is not rigidly connected to the shell, and therefore "floats" in relation to the shell, allowing the tubes to expand freely relative to the shell.

The Rong et al. heat exchanger is typically applied as a fuel reformer in which the floating header is integrated with a cylindrical receptacle for a catalyst. Shell and tube heat exchangers have numerous other applications, and there remains a need to provide solutions for differential thermal expansion in shell and tube heat exchangers for other applications.

SUMMARY OF THE INVENTION

In one aspect, there is provided a heat exchange device comprising a first heat exchanger section and a second heat exchanger section arranged in series. The heat exchange device comprises: (a) an inner shell having a first end and a second end, and having an inner shell wall extending along an axis between the first and second ends, wherein the first heat exchanger section and the second heat exchanger section are enclosed within the inner shell wall; (b) a first fluid inlet provided in the first heat exchanger section and a first fluid outlet provided in the second heat exchanger section; (c) a second fluid inlet provided in the second heat exchanger section and a second fluid outlet provided in the first heat exchanger section; (d) an axially-extending first fluid flow passage extending through both the first and second heat exchanger sections from the first fluid inlet to the first fluid outlet, wherein the first fluid flows between the first and second heat exchanger sections through an internal connecting passage located inside the inner shell; (e) an axially-extending second fluid flow passage extending through both the first and second heat exchanger sections from the second fluid inlet to the second fluid outlet, wherein the first and second fluid flow passages are sealed from one another, and wherein the second fluid flows between the second and first heat exchanger sections through an external connecting passage located outside the inner shell; (f) an outer shell enclosing the external connecting passage; (g) at least one aperture through the inner shell in the second heat exchanger section through which the second fluid flows from the second heat exchanger section into the external connecting passage; and (h) at least one aperture through the inner shell in the first heat exchanger section through which the second fluid flows from the external connecting passage into the first heat exchanger section. The at least one aperture in the first heat exchanger section comprises a first axial gap which is provided between a first portion of the inner shell wall and a second portion of the inner shell wall.

In another aspect, the first and second portions of the inner shell wall are completely separated by said first axial gap except that, prior to first use of the device, the first and second portions of the inner shell wall are joined together by a plurality of webs, each of which traverses the first axial gap. The webs may be of sufficient thickness and rigidity such that they hold the first and second portions of the inner shell wall together during manufacture of the heat exchange device, and wherein the webs are thin enough that they are broken by a force of axial thermal expansion during use of the heat exchange device.

In another aspect, the outer shell has an axially extending outer shell wall which surrounds the first axial gap, and wherein the outer shell wall is spaced from the inner shell wall so that the external connecting passage comprises an annular space. The outer shell may have a first end which is sealingly secured to an outer surface of the first portion of the inner shell wall, and a second end which is sealingly secured to an outer surface of the second portion of the inner shell wall.

In another aspect, the second heat exchanger section comprises a concentric tube heat exchanger. The concentric tube heat exchanger may comprise: (a) an axially extending intermediate tube which is at least partially received within the first portion of the inner shell wall and is spaced therefrom so that an outer annular space is provided between the inner shell wall and the intermediate tube, wherein the outer annular space comprises part of the second fluid flow passage and is located between the second fluid inlet and the at least one aperture through the inner shell in the second heat exchanger section through which the second fluid flows from the second heat exchanger section into the external connecting passage; (b) an axially extending inner tube received within the intermediate tube and spaced therefrom so that an inner annular space is provided between the inner tube and the intermediate tube, wherein the inner annular space comprises part of the first fluid flow passage, and is located between the internal connecting passage and the first fluid outlet. At least one end of the inner tube may be closed in order to prevent fluid flow therethrough.

In another aspect, the outer annular space of the concentric tube heat exchanger may have closed ends, and the second fluid inlet may be provided in the inner shell. Also, the at least one aperture through which the second fluid flows from the second heat exchanger section into the external connecting passage may comprise a plurality of spaced-apart apertures through the inner shell.

In another aspect, the first heat exchanger section may comprise a shell and tube heat exchanger. The shell and tube heat exchanger may comprise: (a) a first plurality of axially extending, spaced apart tubes enclosed within the inner shell, each of the tubes of the first plurality having a first end, a second end and a hollow interior, the first and second ends being open; wherein the hollow interiors of the first plurality of tubes together define part of the first fluid flow passage; (b) a first header having perforations in which the first ends of the first plurality of tubes are received in sealed engagement, wherein the first header has an outer peripheral edge which is sealingly secured to the inner shell wall; (c) a second header having perforations in which the second ends of the first plurality of tubes are received in sealed engagement, wherein the second header has an outer peripheral edge which is sealingly secured to the inner shell wall, wherein a space enclosed by the inner shell and the first and second headers defines part of the second fluid flow passage; wherein the first header is attached to the first portion of the inner shell and the second header is attached to the second portion of the inner shell, such that the first axial gap between the first and second portions of the inner shell wall provides communication between the external connecting passage and the space enclosed by the inner shell and the first and second headers.

The second fluid outlet of the shell and tube heat exchanger may comprise an aperture through the inner shell wall and is located between the first header and the second header, wherein the first header and the second fluid outlet are located proximate to the first end of the inner shell.

In another aspect, the first heat exchanger section may further comprise a first baffle plate extending across the space enclosed by the inner shell and the first and second headers and dividing said space into a first portion and a second portion. The first baffle plate may have an outer peripheral edge which is close to or in contact with the inner shell wall, a plurality of perforations through which the first plurality of tubes extend, and an aperture which provides communication between the first and second portions of said space. The outer peripheral edge of the first baffle plate may be sealingly secured to the inner shell wall. The first baffle plate may comprise a flat, annular plate which extends transversely across the space enclosed by the inner shell and the first and second headers, wherein the aperture through the first baffle plate is located in a central portion of the first baffle plate, and wherein the first baffle plate is located approximately midway between the first and second headers.

In another aspect, the second fluid outlet may be located in the first portion of said space in the shell and tube heat exchanger, and the first heat exchanger section may further comprise a second baffle plate having an axially extending tubular side wall having a hollow interior and which is open at both ends; wherein the second baffle plate is located within the first portion of said space and extends axially between the first baffle plate and the first header; wherein one end of the second baffle plate abuts the first baffle plate with the tubular side wall of the second baffle plate surrounding the aperture of the first baffle plate such that the aperture of the first baffle plate communicates with the hollow interior of the tubular side wall of the second baffle plate; and wherein the tubular side wall of the second baffle plate has at least one aperture providing communication between the hollow interior of the second baffle plate and the second fluid outlet. The at least one aperture in the tubular side wall of the second baffle plate faces away from the aperture defining the second fluid outlet, and the aperture in the tubular side wall of the second baffle plate may be angularly spaced from the aperture defining the second fluid outlet by about 180 degrees. Furthermore, the aperture in the tubular side wall of the second baffle plate may comprise an axially extending slot which may, for example, extend from one end to the other end of the second baffle plate.

In another aspect, the heat exchange device comprises a steam generator, wherein the first fluid is a hot tail gas and the second fluid is liquid water and steam.

In another aspect, the second heat exchanger section comprises a second shell and tube heat exchanger comprising: (a) a second plurality of axially extending, spaced apart tubes enclosed within the inner shell, each of the tubes of the second plurality having a first end, a second end and a hollow interior, the first and second ends being open; wherein the hollow interiors of the second plurality of tubes together define part of the first fluid flow passage; (b) a third header having perforations in which the first ends of the second plurality of tubes are received in sealed engagement, wherein the third header has an outer peripheral edge which is sealingly secured to the inner shell wall; (c) a fourth header having perforations in which the second ends of the second plurality of tubes are received in sealed engagement, wherein the second header has an outer peripheral edge which is sealingly secured to the inner shell wall, wherein a space enclosed by the inner shell and the third and fourth headers defines part of the second fluid flow passage; (d) a second fluid inlet in flow communication with the second portion of the second fluid flow passage; and (e) a second fluid outlet in flow communication with the second portion of the second fluid flow passage.

In another aspect, the third header of the second shell and tube heat exchanger is attached to the first portion of the inner shell wall. Also, the inner shell wall may comprise a third portion to which the fourth header is attached; a second axial gap is provided between the first and third portions of the inner shell wall; and the second axial gap provides communication between the space enclosed by the inner shell and the third and fourth headers, and the external connecting passage.

In another aspect, the first and third portions of the inner shell wall are completely separated by said second axial gap except that, prior to first use of the device, the first and third portions of the inner shell wall are joined together by a plurality of webs, each of which traverses the second axial gap; wherein the webs are of sufficient thickness and rigidity such that they hold the first and third portions of the inner shell wall together during manufacture of the heat exchange device, and wherein the webs are thin enough that they are broken by a force of axial thermal expansion during use of the heat exchange device.

In another aspect, the heat exchange device may further comprise a catalyst bed enclosed within the first portion of the inner shell wall and located in the inner connecting passage. The heat exchange device may comprise, for example, a water gas shift reactor, wherein the first fluid is a hot synthesis gas and the second fluid is air.

In another aspect, the second shell is provided with axially expandable corrugations.

In another aspect, the first heat exchanger section comprises: (a) a single heat exchange tube having a first end, a second end and a hollow interior, the first and second ends being open; wherein the hollow interior of the heat exchange tube defines part of the first fluid flow passage; (b) a first header having a perforation in which the first end of the heat exchange tube is received in sealed engagement, wherein the first header has an outer peripheral edge which is sealingly secured to the inner shell wall; (c) a second header having a perforation in which the second end of the heat exchange tube is received in sealed engagement, wherein the second header has an outer peripheral edge which is sealingly secured to the inner shell wall, wherein a space enclosed by the inner shell and the first and second headers defines part of the second fluid flow passage; wherein the first header is attached to the first portion of the inner shell and the second header is attached to the second portion of the inner shell, such that the first axial gap between the first and second portions of the inner shell wall provides communication between the external connecting passage and the space enclosed by the inner shell and the first and second headers. For example, the heat exchange tube may comprise a corrugated tube wall.

In another aspect, the first heat exchanger section may comprise a concentric tube heat exchanger comprising: (a) an axially extending intermediate tube which is received within the inner shell wall and is spaced therefrom so that an outer annular space is provided between the inner shell wall and the intermediate tube, wherein the outer annular space comprises part of the second fluid flow passage; (b) an axially extending inner tube received within the intermediate tube and spaced therefrom so that an inner annular space is provided between the inner tube and the intermediate tube, wherein the inner annular space comprises part of the first fluid flow passage. For example, the intermediate tube may have expanded ends which are sealingly secured to the inner shell, and wherein the outer annular space is in communication with the second fluid outlet and in communication with the external connecting passage through said axial gap. Also, the intermediate tube may be provided with corrugations to permit axial expansion of the intermediate tube.

BRIEF DESCRIPTION OF THE DRAWINGS

The invention will now be described, by way of example only, with reference to the accompanying drawings in which.

DETAILED DESCRIPTION

Figure 1:
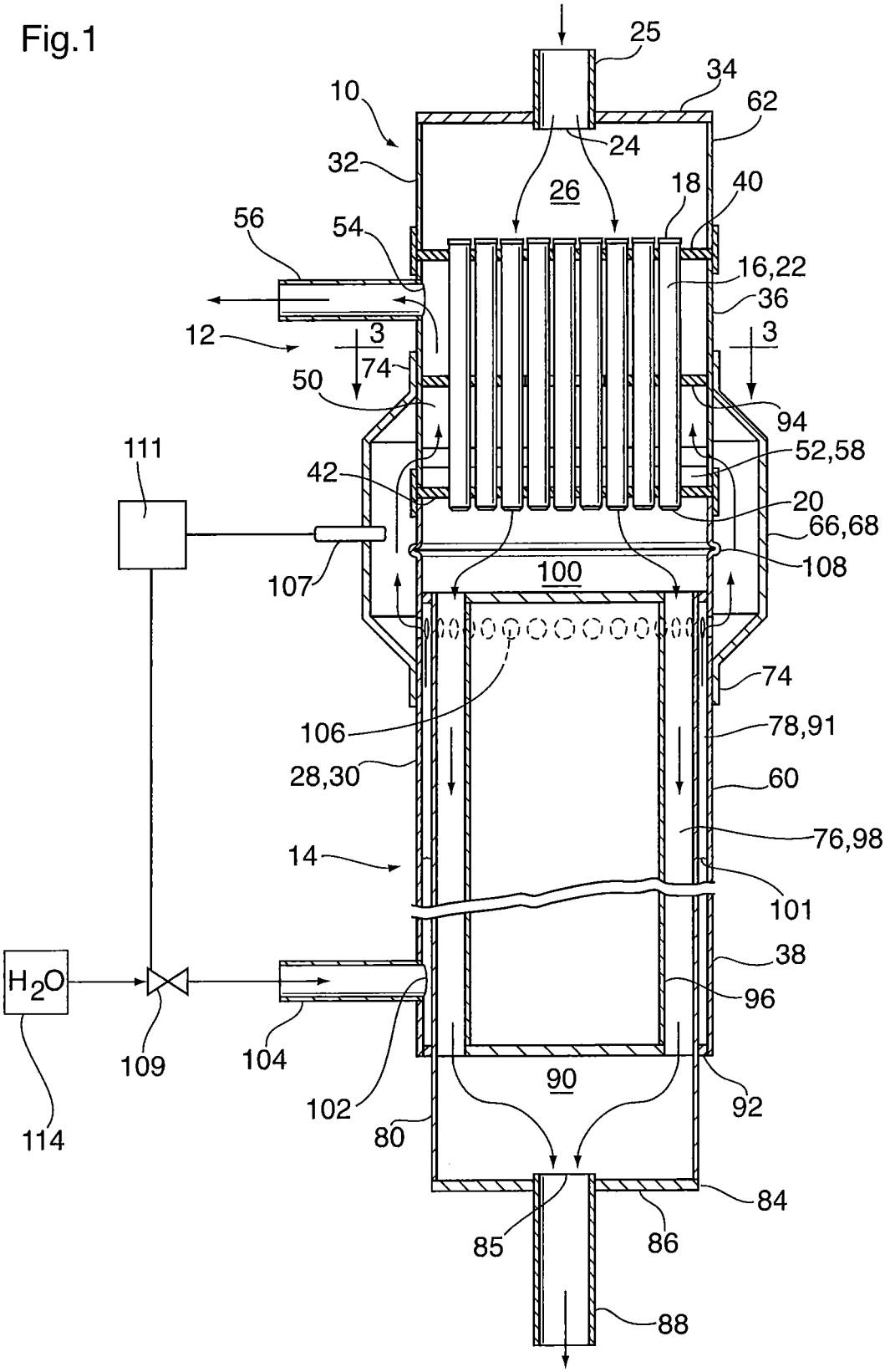
FIG. 1 is an axial cross-section along line 1-1 of FIG. 2, illustrating a heat exchanger according to a first embodiment of the invention.
Figure 1A:
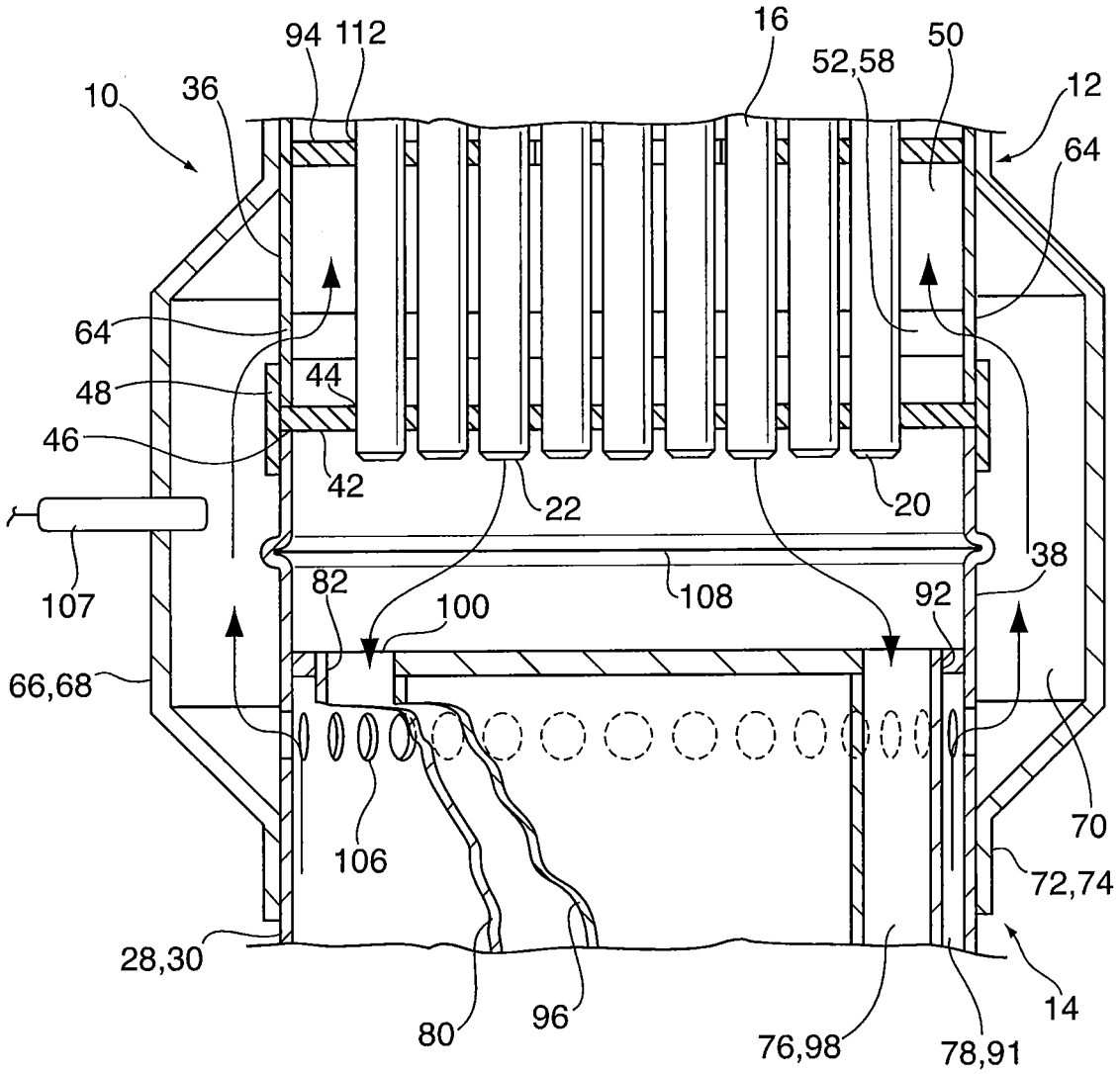
FIG. 1A is a detail view of the upper portion of the heat exchanger of FIG. 1.
Figure 1B:
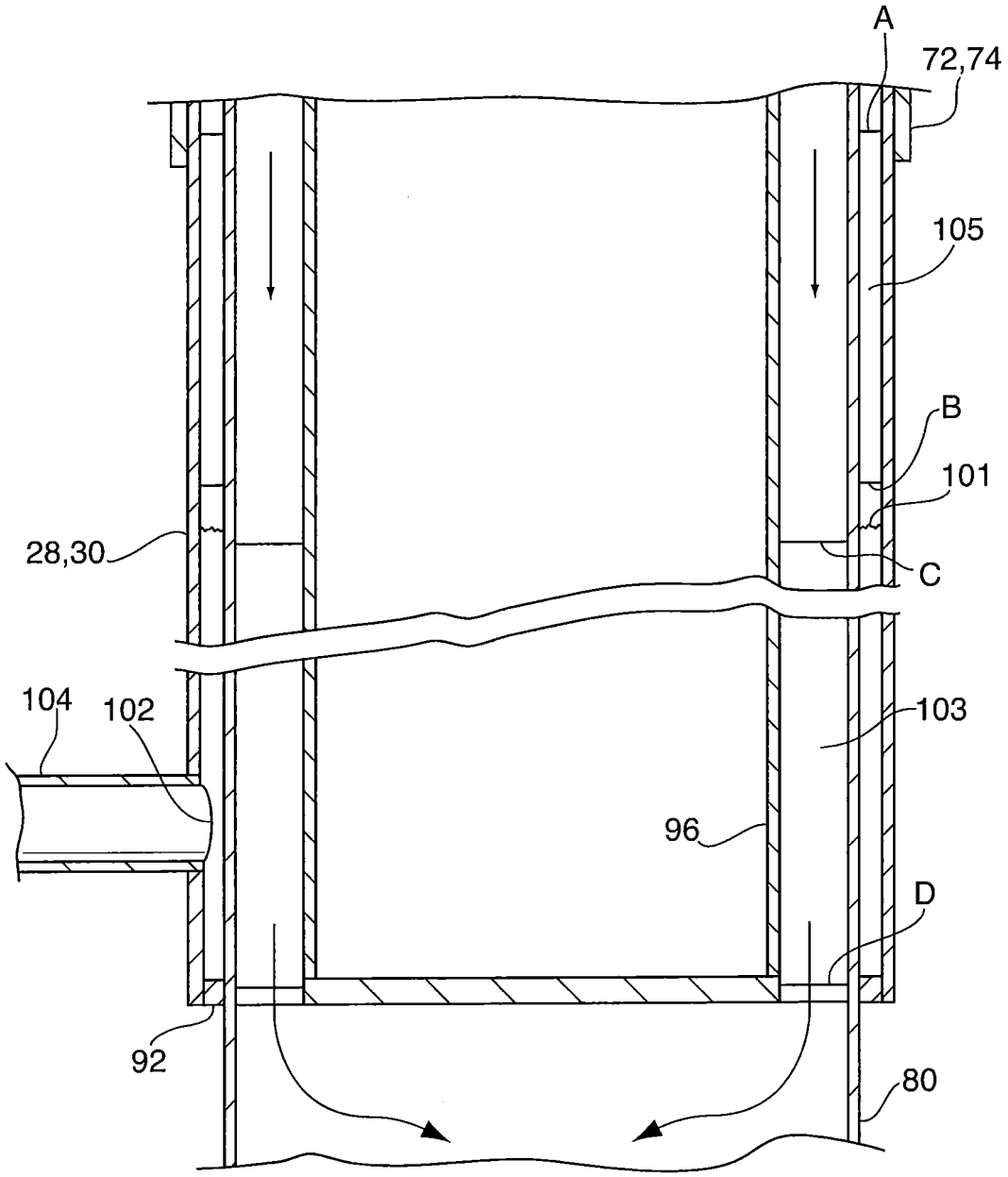
FIG. 1B is a detail view of the lower portion of the heat exchanger of FIG. 1.

A heat exchange device 10 according to a first embodiment of the invention is now described below with reference to FIGS. 1 to 9.

Terms such as "upstream", "downstream", "inlet" and "outlet" are used in the following description to assist in describing the embodiments shown in the drawings. It will be appreciated, however, that these terms are used for convenience only, and that do not restrict the directions of fluid flow through the heat exchangers described herein. Rather, it is to be understood that the direction of flow of one or both fluids flowing through the heat exchangers may be reversed, where such flow reversal is advantageous.

Heat exchange device 10 is a steam generator or combined steam generator and catalytic converter in which heat from a hot waste gas (tail gas) is used to convert liquid water to superheated steam. Steam generator 10 generally comprises two heat exchanger sections, a first heat exchanger section 12 comprising a shell and tube heat exchanger and a second heat exchanger section 14 comprising a co-axial, concentric tube heat exchanger. In use, the device 10 may be oriented as shown in FIG. 1, with the second heat exchanger section 14 above the first heat exchanger section 12, for reasons which will become apparent below.

The shell and tube heat exchanger 12 includes a plurality of axially extending, spaced apart tubes 16 arranged in a tube bundle in which the tubes 16 are in parallel spaced relation to one another with their ends aligned. Although not necessary to the invention, the tube bundle may have a roughly cylindrical shape as is apparent from FIGS. 3, 8 and 9. Each tube 16 is cylindrical and has a first (upstream) end 18, a second (downstream) end 20 and a hollow interior. The first and second ends 18, 20 are open, with the hollow interiors of the tubes 16 together defining a first portion of a first fluid flow passage 22. In this embodiment of the invention, the first fluid is the hot waste gas or tail gas, and therefore the first portion of the first fluid flow passage 22 is sometimes referred to herein as the "upstream tail gas passage 22". As can be seen from FIG. 1, the tail gas entering the steam generator 10 flows into the first ends 18 of tubes 16, through the hollow interiors of tubes 16 and exits the tubes 16 through the second ends 20.

The steam generator 10 also includes a first fluid inlet 24, sometimes referred to herein as the "tail gas inlet 24". The tail gas inlet 24 not only functions as an inlet to allow entry of the tail gas into the upstream tail gas passage 22, but also functions as an inlet through which the tail gas enters the steam generator 10 from an external source (not shown). Therefore, the tail gas inlet 24 is provided with a tail gas inlet fitting 25 through which the tail gas is received from the external source. The tail gas inlet 24 is in flow communication with the first ends 18 of the plurality of tubes 16. As shown in FIG. 1, an inlet manifold space 26 may be provided between the first fluid inlet 24 and the first ends 18 of tubes 16.

The steam generator 10 further comprises a first shell 28 (sometimes referred to herein as the "inner shell") having an axially extending first shell wall 30 (sometimes referred to herein as the "inner shell wall") surrounding the plurality of tubes 16. In this embodiment, the first shell wall 30 extends throughout the first heat exchanger section 12 and throughout at least a portion of the second heat exchanger section 14. Although not essential to the invention, the first shell wall 30 may have a cylindrical shape.

Certain details of construction of the first shell 28 are shown in the drawings. In this regard, the first shell 28 may be constructed from two or more segments joined together end-to-end. For example, in the embodiment shown in FIG. 1, the first shell 28 comprises an end cap section 32 including a closed end wall 34 in which the first fluid inlet 24 is provided; a middle section 36 which is shown in isolation in FIG. 5A and is further discussed below with reference to FIGS. 5A-5C; and an end section 38 which forms part of the second heat exchanger section 14. It is to be understood that this type of shell construction, while useful in this embodiment, is an optional construction which is not necessary to the invention.

The steam generator 10 further comprises a pair of headers, namely a first (upstream) header 40 located proximate to the first ends 18 of tubes 16, and a second (downstream) header 42 located proximate to the second ends 20 of tubes 16. The headers 40, 42 are each provided with a plurality of perforations 44 (as shown in FIG. 3) in which the respective first and second ends 18, 20 of tubes 16 are received. As shown in FIG. 1, the ends 18, 20 of tubes 16 may extend completely through the perforations 44 of headers 40, 42, and are sealed with and rigidly secured to the headers 40,42 by any convenient means. For example, where the tubes 16 and headers 40,42 are made of metal, they may be secured together by brazing or welding.

Each header 40, 42 has an outer peripheral edge 46 at which it is sealed and secured to the first shell wall 30. Thus, the headers 40,42 have a circular shape for attachment to the first shell wall 30. It can be seen from the drawings that the first shell wall 30 and the first and second headers 40, 42 together define a second portion of a second fluid flow passage 50. A second fluid, which in the present embodiment comprises steam and/or liquid water, flows through flow passage 50 in contact with outer surfaces of the first plurality of tubes 16. Accordingly, the second portion of the second fluid flow passage 50 is sometimes referred to herein as the "downstream steam passage 22". The downstream steam passage may be provided with at least one baffle plate (described below) to create a tortuous path for the steam flowing through passage 22, lengthening the flow path and enhancing heat transfer from the tail gas to the steam.

In the illustrated embodiment, the three sections 32, 36, 38 of first shell 28 are joined together by headers 40, 42. In this regard, each header has an outer peripheral edge 46 which is provided with an axially-extending peripheral wall 48, wherein the wall 48 receives and overlaps two of the sections making up the first shell 28. More specifically, the first header 40 connects the end cap section 32 and one end of the middle section 36, while the second header 42 connects the opposite end of middle section 36 with end section 38. The peripheral walls 48 of headers 40, 42 are joined to shell sections 32, 36 and 38 by lap joints, which may be formed by brazing or welding. As already explained above, this multi-section construction of shell 28 is optional, as is the use of headers 40,42 to connect the sections 32, 36, 38. It will be appreciated that there are numerous other ways to construct the steam generator 10. For example, the first shell 28 may be of unitary construction with the peripheral edges 46 of headers 40, 42 attached and sealed to the inner surface of the first shell wall 30. However, the segmented construction shown in the drawings provides ease of assembly and ensures proper alignment and sealing of the headers 40, 42 in this particular embodiment.

The tube and shell heat exchanger 12 is also provided with inlet and outlet openings to allow the second fluid (i.e. steam) to enter and exit the second fluid flow passage 50. In this regard, a second fluid inlet 52 (also referred to herein as the "steam inlet 52") and a second fluid outlet (also referred to herein as the "superheated steam outlet 54") are provided in the first shell wall 30, in flow communication with the interior of the downstream steam passage 50. Because the tail gas and the steam are in counterflow with one another, the steam inlet 52 (described further below) is located proximate to the second header 42 while the superheated steam outlet 54 is located proximate to the first header 40. The superheated steam outlet 54 not only functions as an outlet to allow discharge of the steam from the downstream steam passage 50, but also functions as an outlet through which the steam exits the steam generator 10 in superheated form, for use in an external system component (not shown). Therefore, the superheated steam outlet 54 is provided with a steam outlet fitting 56 through which the superheated steam is discharged to the external system component.

As mentioned above, the steam inlet 52 is provided in the first shell wall 30 and, in the embodiment shown in FIGS. 1-9, comprises a slot or gap 58 extending about the entire circumference, or substantially the entire circumference, of the first shell wall 30, and separating the shell wall 30 into a first portion 60 and a second portion 62. In the embodiment shown in FIG. 1, the first portion 60 of first shell wall 30 includes the portion of shell wall 30 below gap 58 (downstream relative to the direction of flow of the tail gas), while the second portion comprises the portion of shell wall 30 above gap 58 (upstream relative to the direction of flow of the tail gas). Thus, the first portion 60 of shell wall 30 is axially spaced from the second portion 62 of shell wall 30. The gap 58 is therefore sometimes referred to herein as the "first axial space". In the embodiment shown in FIGS. 1-9, the gap 58 serves as the steam inlet 52 into the downstream steam passage 50, although it will be appreciated that the gap 58 may instead serve as an outlet where the direction of flow of the steam is the opposite of that shown in FIG. 1.

Figure 5A:
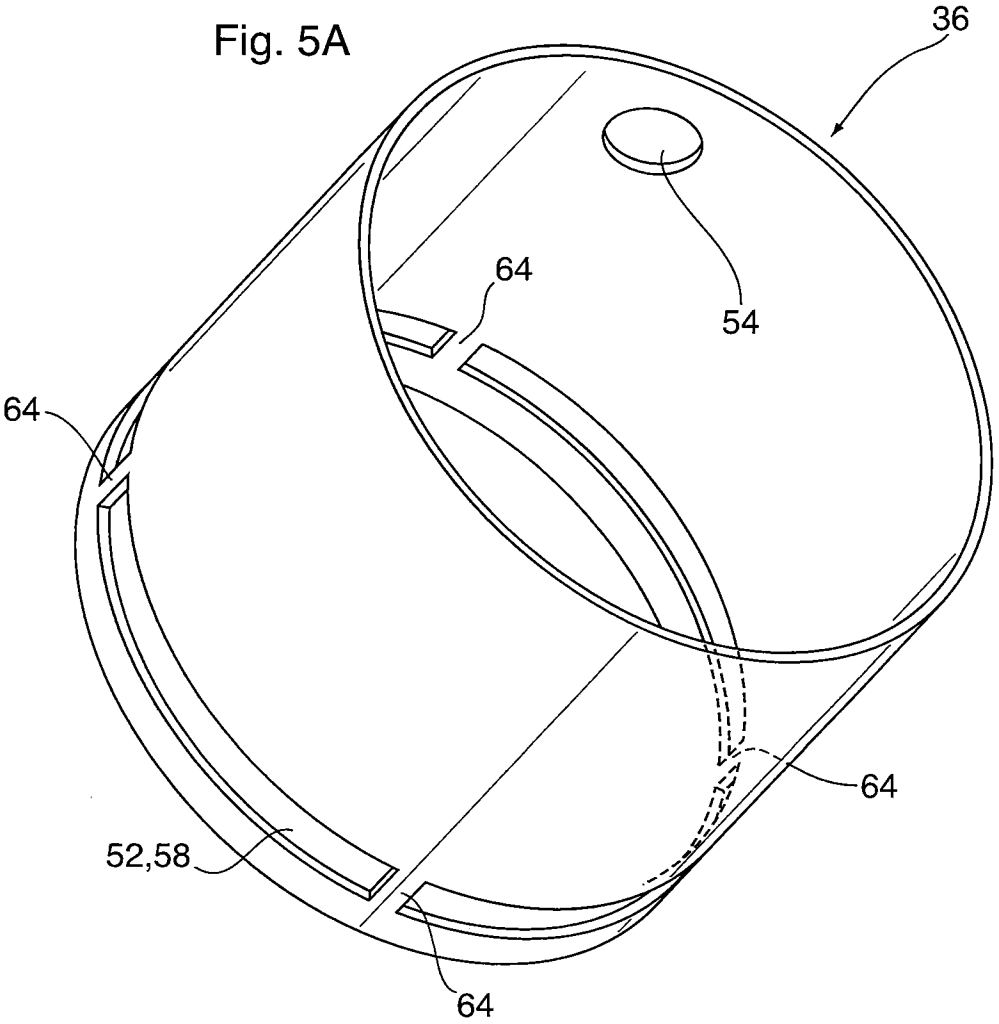
FIG. 5A illustrates a segment of one of the shells thereof.

FIG. 5A shows the middle section 36 of the first shell wall 30 in isolation, prior to assembly of the device 10. The middle section 36 comprises an open-ended cylindrical tube having an opening for the superheated steam outlet 54, and also having a circumferentially extending slot which comprises the steam inlet 52 and gap 58. As shown, the gap 58 and the superheated steam outlet 54 are located close to opposite ends of the middle shell section 36, thereby providing a required spacing between the inlet 52 and outlet 54 of the second fluid flow passage 50. Thus, in the assembled steam generator 10, the gap 58 is located proximate to the second header 42 whereas the superheated steam outlet 54 is provided proximate to the first header 40.

As shown in FIG. 5A, the middle section 36 of first shell wall 30 is provided with a plurality of webs 64 extending axially across the gap 58 in order to provide the middle section 36 of the first shell wall 30 with a unitary structure. Also, in the assembled steam generator 10 shown in FIG. 1, the webs 64 provide a connection between the first and second portions 60, 62 of the first shell wall 30. The webs 64 are of sufficient thickness and rigidity such that they hold the first and second portions 60, 62 together to assist in assembly of the steam generator 10 during the manufacturing process. However, the webs 64 are sufficiently thin that they do not significantly impair the flow of the second fluid into or out of the first shell 28, and such the gap 58 is substantially continuous.

Figure 5B:
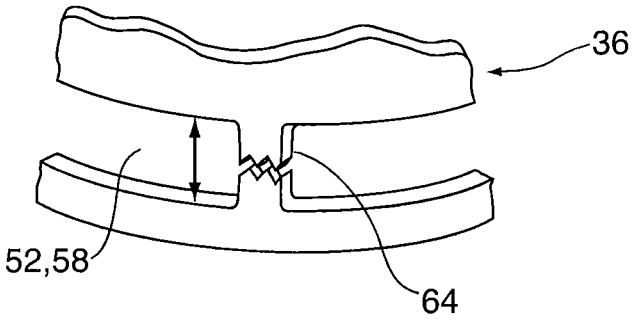
FIGS. 5B and 5C are close-up views showing alternate web configurations in the shell segment of FIG. 5A.
Figure 5C:
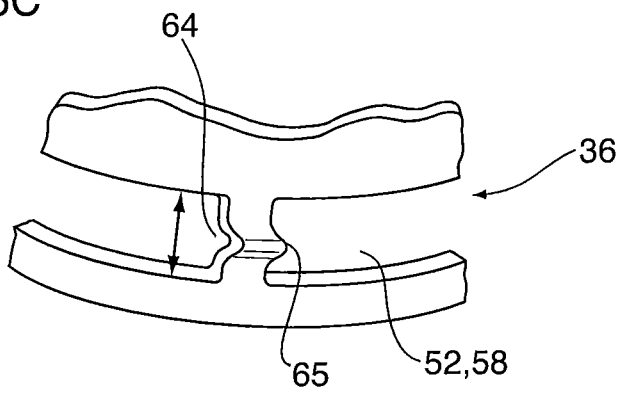

In the embodiment shown in FIG. 5B, the webs 64 are sufficiently thin that they are broken by the forces of axial thermal expansion of the plurality of tubes 16 during use of the steam generator 10. In an alternative embodiment shown in FIG. 5B, the middle section 36 of first shell wall 30 is provided with webs 64 having a rib or corrugation 65 which provides the web 64 with the ability to expand and contract in the axial direction in response to axial thermal expansion of the middle section 36 of first shell wall 30. Thus, whether the webs 64 are breakable or expandable, they provide the shell wall 30 with compliance, permitting the headers to "float" and thereby avoiding damage to the heat exchanger caused by the axial forces of differential thermal expansion.

Figure 3A:
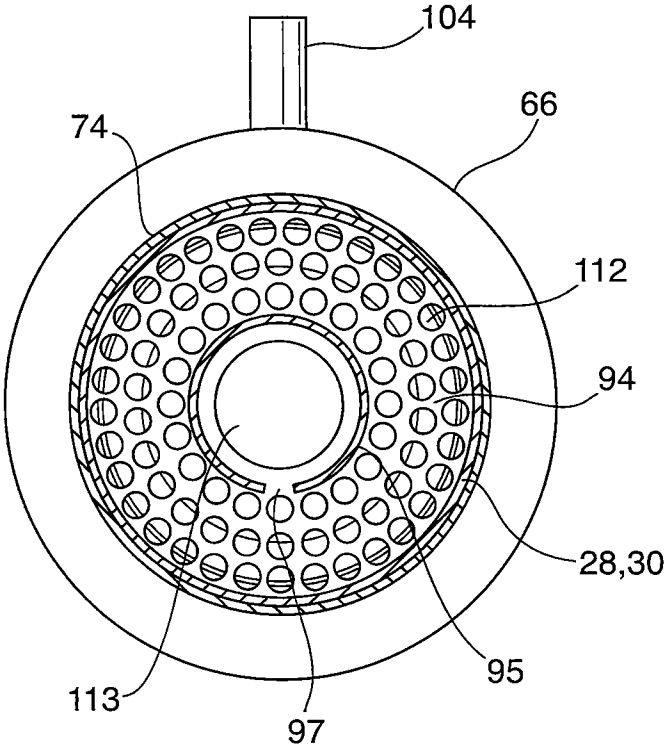
FIG. 3A is a transverse cross-section thereof, along line 3-3' of FIG. 1.
Figure 2:
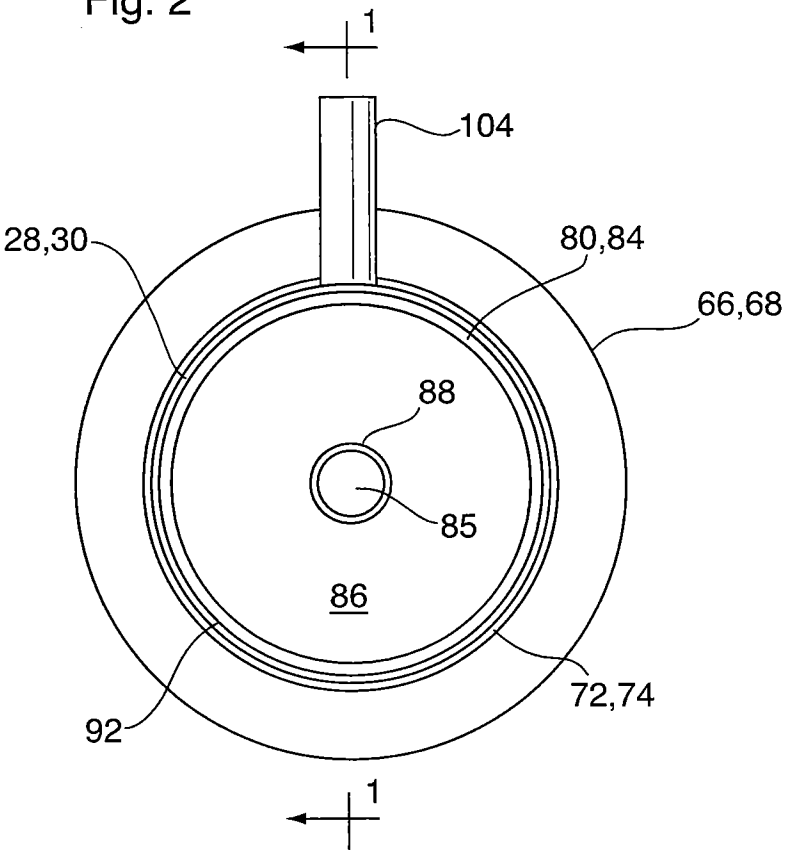
FIG. 2 is an elevation view thereof, taken from the outlet end of the heat exchanger.
Figure 3B:
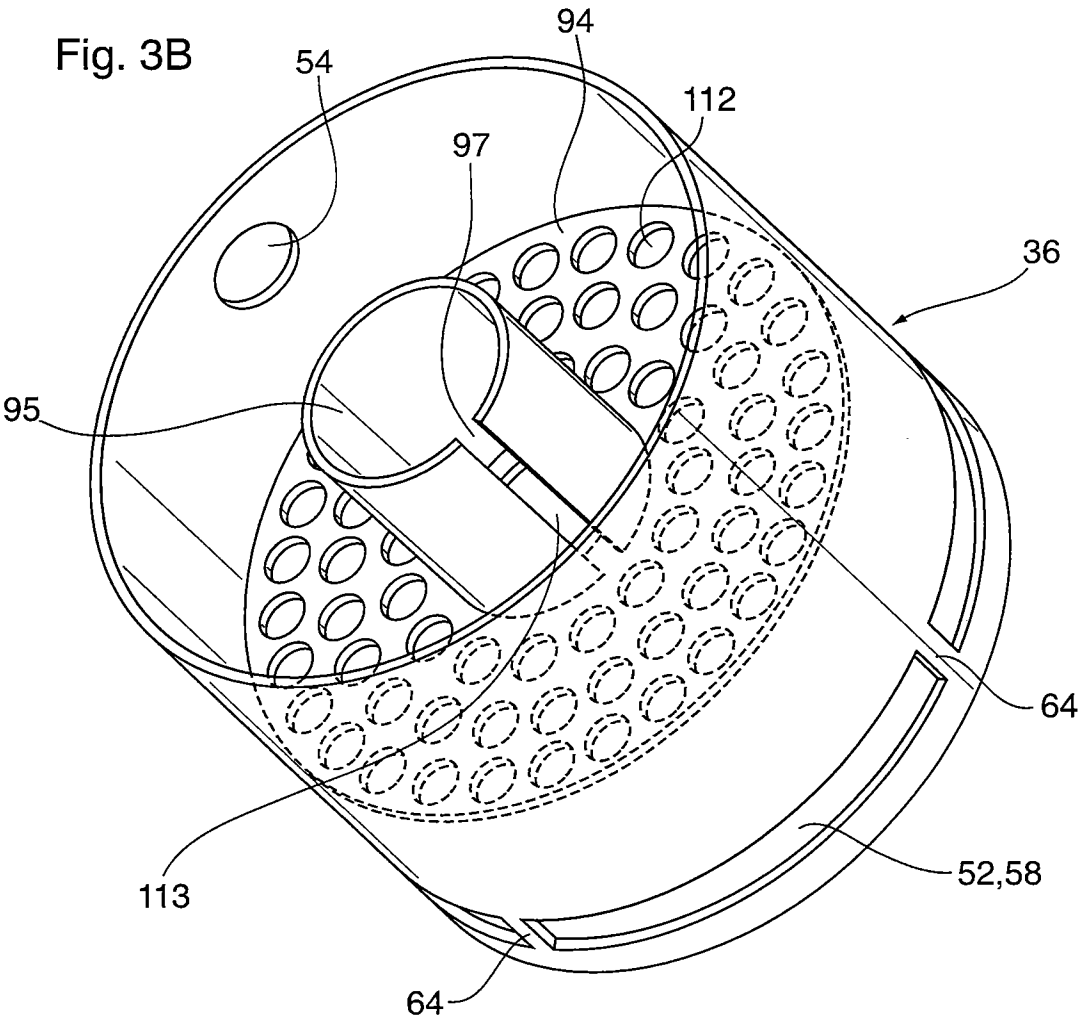
FIG. 3B illustrates a segment of one of the shells thereof, showing a pair of baffle plates.
Figure 4:
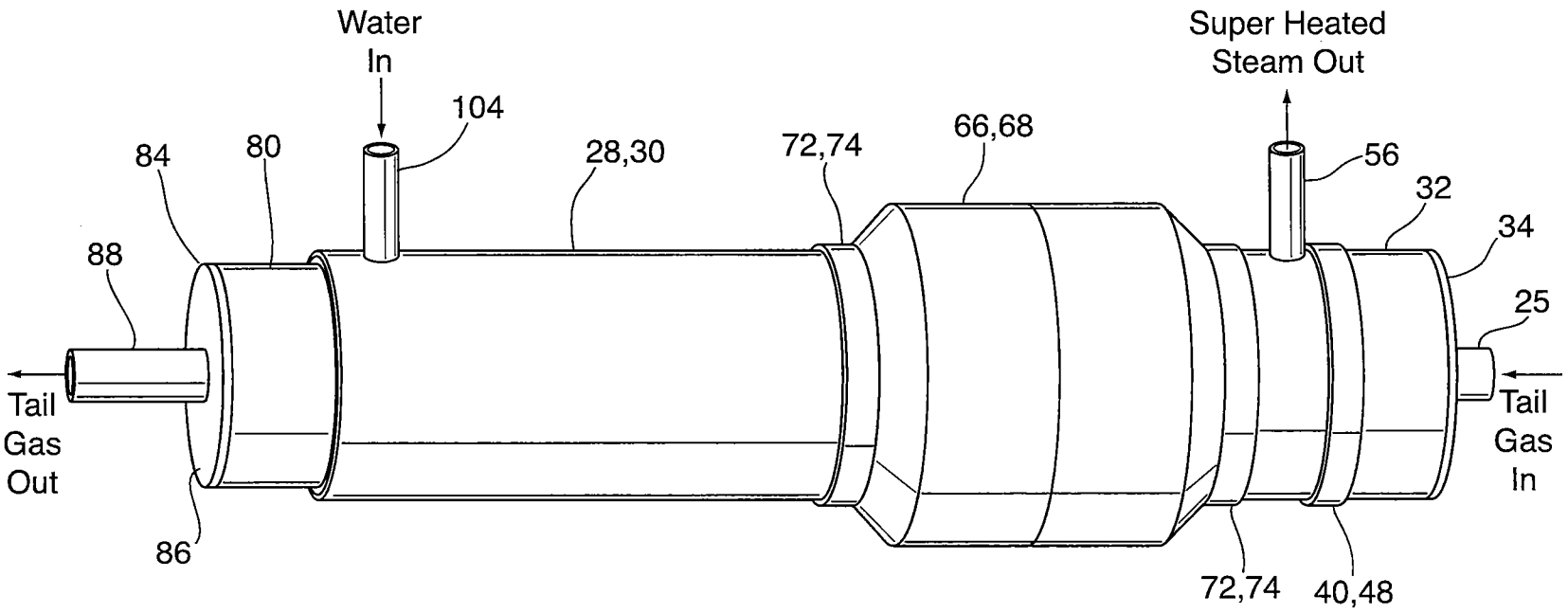
FIG. 4 is a perspective view thereof.

As mentioned above, one or more baffles may be provided to create a tortuous path for the steam flowing through passage 22. An example of a baffle arrangement is illustrated in FIGS. 1, 3A and 3B and is now described below. The baffle arrangement includes a first baffle plate 94 which, as shown in FIG. 1, comprises a flat plate extending transversely across the direction of steam flow through passage 22, and is located between the steam inlet 52 (i.e. slot 58) and the steam outlet 54. The first baffle plate 94 has an outer peripheral edge which is located close to, or in contact with, the inner surface of first shell 28 so as to prevent substantial bypass flow around baffle plate 94. The outer peripheral edge of the first baffle plate may be sealingly secured to the inner shell wall. An outer annular portion of first baffle plate 94 is provided with holes 112 which are sized to closely receive tubes 16. The outer portion of first baffle plate 94 surrounds an opening 113 which may be centrally located in the baffle plate 94, and through which substantially all of the steam flows between the steam inlet 52 and the steam outlet 54.

The baffle arrangement also includes a second baffle plate 95 (shown in FIGS. 3A and 36 only) upstanding from the first baffle plate 94, and extending from the first baffle plate 94 in the direction of steam flow (i.e. upwardly) toward the first header 40. The second baffle plate 95 comprises an axially extending tubular side wall which is open at both ends and has a hollow interior. One end of the second baffle plate 95 abuts the first baffle plate and is positioned over the central opening 113 of first baffle plate 94 with the tubular side wall surrounding the central opening 113. Therefore, the central opening 113 of the first baffle plate 94 communicates with the hollow interior of the tubular side wall, such that the second baffle plate 95 receives the steam flowing through opening 113.

The second baffle plate 95 has at least one aperture 97 in the tubular side wall providing communication between the hollow interior of the second baffle plate 95 and the steam outlet 54. In this regard, the aperture 97 may face away from the steam outlet 54 so that the steam exiting aperture 97 must flow around the tubular side wall of second baffle plate 95 to reach the steam outlet 54. As shown, the aperture 97 may be angularly spaced from the steam outlet 54 by an angle of about 180 degrees so that the aperture 97 faces directly away from the steam outlet. In the embodiment shown in the drawings the aperture 97 comprises an axially extending slot which may extend throughout the height of the second baffle plate 95 from one end to another. However, it will be appreciated that the tubular side wall may be provided with one or more of said apertures 97, and the apertures may comprise discrete openings or holes instead of an elongate slot. Furthermore, the holes need not be axially aligned with one another but may be spaced apart around the circumference of the tubular side wall of baffle 95.

It can be seen that the baffle arrangement including baffle plates 94 and 95 creates a tortuous path for the steam flowing through passage 22, lengthening the flow path and enhancing heat transfer from the tail gas to the steam. In the embodiment shown in the drawings, the central opening 113 of baffle plate 94 is circular and the second baffle plate 95 has a substantially cylindrical, "C" shape. It will be appreciated that other shapes are possible for opening 113 and baffle plate 95.

The steam generator 10 also includes a second shell 66 (sometimes referred to herein as the "outer shell") having an axially extending second shell wall 68 (sometimes referred to herein as the "outer shell wall 68") which extends along at least a portion of the length of the first shell 28. The second shell 66 surrounds the portion of first shell 28 in which the gap 58 is located and is of greater diameter than the first shell 28, such that the second shell wall 68 is spaced radially outwardly from the first shell wall 30. This radial spacing provides an annular manifold space 70 (also referred to herein as an "external flow passage") in flow communication with the downstream steam passage 50 through gap 58.

Because the second shell 66 provides a manifold space 70 over the gap 58, it is sealed at its ends 72 to the outer surface of the first shell wall 30. In this regard, the second shell wall 66 is reduced in diameter at its ends 72, terminating in an axially extending collar 74 which is sealed to the first shell wall 30 by brazing or welding. As shown in FIG. 1, one of the collars 74 is connected to the first portion 60 of the first shell 28, while the collar 74 at opposite end 72 is connected to the second portion 62 of the first shell, and is positioned on the first shell wall 30 between the gap 58 and the superheated steam outlet 54. The second shell wall 66 of steam generator 10 has ends which are inwardly inclined toward the axial collars 74. The inwardly inclined ends are somewhat compliant and accommodate axial expansion and contraction of the second shell wall 66, in response to thermal expansion and contraction in the tubes 16 and the first shell wall 30. Rather than inclined end portions, the second shell wall 66 may instead be provided with circumferential corrugations or "bellows" to accommodate thermal expansion. These corrugations may be similar in form to corrugated ribs 204 in the embodiment shown in FIG. 10.

As mentioned above, the heat exchange device 10 further comprises a second heat exchanger section 14 which is arranged in series with the first heat exchanger section 12. The second heat exchanger section 14, also referred to herein as "boiler 14", includes a second portion of the first fluid flow passage 76 (also referred to herein as the "downstream tail gas passage 76"), which receives tail gas from the upstream tail gas passage 22. The second heat exchanger section 14 also includes a first portion of the second fluid flow passage 78 (also referred to herein as the "upstream water/steam passage 78"), in which liquid water is converted to steam which then flows to the downstream steam passage 50.

The second heat exchanger section 14 of steam generator 10 is in the form of a concentric tube heat exchanger in which the first portion 60 of the first shell wall 30 forms an outermost tube layer. The concentric tube heat exchanger 14 further comprises an axially extending intermediate tube 80 which is at least partially received within the first portion 60 of the first shell wall 30.

In the embodiment shown in the drawings, the intermediate tube 80 has a first end 82 which is received inside the first shell wall 30 in close proximity to the first heat exchanger section 12, and a second end 84 which protrudes beyond the end of the first shell 28 and terminates with an end wall 86 in which the first fluid outlet 85 (also referred to herein at the "tail gas outlet 85") is provided. The tail gas outlet 85 not only functions as an outlet to allow discharge of the tail gas from the downstream tail gas passage 76, but also functions as an outlet through which the tail gas exits the steam generator 10 in cooled form relative to the temperature at inlet 24, for exhaust or for use in an external system component (not shown). Therefore, the tail gas outlet 85 is provided with a tail gas outlet fitting 88 through which the cooled tail gas is discharged from steam generator 10.

It will be appreciated that there is substantially no heat exchange in the portion of intermediate tube 80 which projects beyond the end of first shell 28. Rather, this projecting portion functions to provide an outlet manifold space 90 for the tail gas discharged from the steam generator 10 through outlet 85.

It can be seen that the upstream water/steam passage 78 is defined within an outer annular space 91 between the first shell wall 30 and the intermediate tube 80, and is closed at its ends, for example by annular sealing rings 92 which fill the annular space 91 and provide a means for connection between the first shell 28 and the intermediate tube 80. Although the ends of the space between the first shell 28 and intermediate tube 80 are sealed by annular rings 92, it will be appreciated that this is not necessary. Rather, the first shell 28 may be reduced in diameter and/or the intermediate tube 80 may be increased in diameter so as to provide points at which the first shell 28 and intermediate tube 80 are connected.

The concentric tube heat exchanger 14 further comprises an axially extending inner tube 96, which is a "blind tube" closed at one or both of its ends, and is received within the intermediate tube 80 wherein the downstream tail gas passage 76 is defined within an inner annular space 98 between the inner tube 96 and the intermediate tube 80. The inner annular space 98 is open at its ends to permit flow therethrough of the tail gas from inner annular space 98 into manifold space 90 and toward the outlet 85.

The concentric tube heat exchanger 14 also comprises a first fluid inlet 100 (also referred to herein as "tail gas inlet 100") through which the tail gas discharged from the shell and tube heat exchanger 12 enters heat exchanger 14. The tail gas inlet 100 comprises a manifold space between the second ends 20 of tubes 16 and an end of the inner annular space 98. Within this tail gas inlet/manifold space 100 the first shell 28 may be provided with one or more circumferentially extending corrugations 108, the purpose and function of which will be described below.

A second fluid inlet 102 (also referred to herein as "water inlet 102") is provided in first shell wall 30, and is in flow communication with the outer annular space 91. The water inlet 102 not only functions as an inlet to allow entry of liquid water into the upstream water/steam passage 78, but also functions as an inlet through which liquid water enters the steam generator 10 from an external source (not shown). Therefore, the water inlet 102 is provided with a water inlet fitting 104 through which the liquid water is received from the external source.

A second fluid outlet 106 (also referred to herein as "steam outlet 106") is provided in first shell wall 30, and is in flow communication with the outer annular space 91. In the steam generator 10 shown in the drawings, the steam outlet 106 comprises one or more apertures formed in the first shell 28, in close proximity to one of the closed ends of the outer annular space 91. These apertures provide a means by which the steam flows out of the outer annular space 91 toward the downstream steam passage 50.

The water inlet 102 receives liquid water from an external source (not shown), and supplies liquid water to upstream water/steam passage 78. The passage 78 serves as a space within which the liquid water is heated by the tail gas flowing through downstream tail gas passage 76. The liquid water is heated to boiling within passage 78 and is converted to steam. Therefore, the lower portion of passage 78 functions as a water reservoir of relatively small volume, the approximate water level 101 being shown in FIG. 1. Therefore, when in use, the device 10 is oriented with the water inlet 102 below the steam outlet 106. For example, as shown in FIG. 1, the device 10 may have a substantially vertical orientation. The volume of liquid water in annular passage 78 is small and provides device 10 with a high degree of responsiveness, meaning that steam is generated very quickly in response to the flow of hot tail gas through the downstream tail gas passage 76.

During operation of the device 10, there may be some fluctuation in the water level 101 in the upstream water/steam passage 78. In order to optimize quick response of the boiler 14, it is desired to maintain the flow of water close to level 101, and below the steam outlet 106. The device 10 may be provided with means for controlling the water level 101 in boiler 14. For example, the device 10 may be provided with a control system, schematically shown in FIG. 1, which includes a thermocouple 107 to monitor the temperature of steam exiting the boiler 14, a valve 109 to control the flow of water flowing from a water source 114 to the water inlet 102 of boiler 14, and an electronic controller 111 which receives temperature information from the thermocouple 107 and controls the operation of valve 109. The thermocouple 107 may be located in manifold space 70 enclosed by second shell 66. Where the steam temperature sensed by thermocouple 107 is too low, the controller 111 will partly or completely close valve to decrease the flow of water into boiler 14 and prevent an excessive rise in the water level 101. On the other hand, where the steam temperature sensed by thermocouple 107 is too high, the controller 111 will partially or completely open the valve 109 so as to increase the flow of water into the boiler 14 and prevent an excessive drop in the water level 101.

As shown in FIG. 1, the second shell 66 also surrounds the portion of first shell 28 in which the steam outlet 106 is formed so as to provide flow communication between the outer annular space 91 and the annular manifold space 70. Once the steam enters manifold space 70, it is able to flow into the downstream steam passage 50 through gap 58. To prevent pooling of water in the bottom of second shell 66, the lower end of second shell 66 is located immediately below the apertures making up the steam outlet 106.

To optimize heat transfer between the hot tail gas and the water/steam in boiler 14, one or both of the downstream tail gas passage 76 and the upstream water/steam passage 78 may be provided with turbulence-enhancing inserts in the form of corrugated fins or turbulizers to create turbulence in the annular passages 76, 78 and thereby improve heat transfer. The turbulence-enhancing insert in the downstream tail gas passage 76 is identified by reference numeral 103 in FIG. 1, and the turbulence-enhancing insert in the upstream water/steam passage 78 is identified by reference numeral 105. The turbulence-enhancing insert 103 is in the form of a sheet which is wrapped around the inner tube 96, with the tops and bottoms of the corrugations making up insert 103 being in contact with inner tube 96 and intermediate tube 80. Similarly, the turbulence-enhancing insert 105 is in the form of a sheet which is wrapped around the intermediate tube 80 and is in contact with the intermediate tube 80 and the first shell wall 30.

Figure 14:
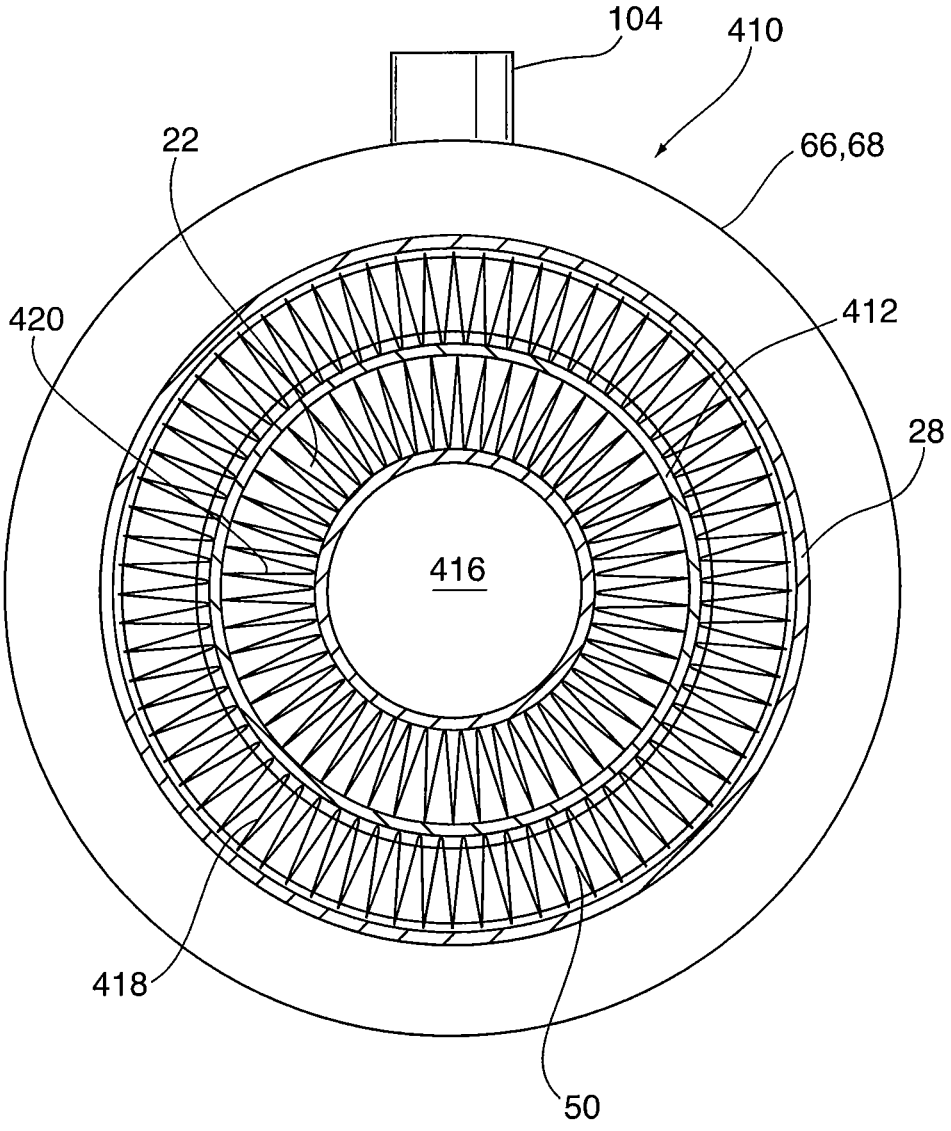
FIG. 14 is a cross-section along line 14-14 of FIG. 13.

The turbulence-enhancing inserts 103, 105 may comprise simple corrugated fins, or may comprise offset or lanced strip fins of the type described in U.S. Pat. No. Re. 35,890 (So) and U.S. Pat. No. 6,273,183 (So et al.). The patents to So and So et al. are incorporated herein by reference in their entireties. The inserts 103, 105 are received within respective passages 76, 78 such that the low pressure drop direction of the insert 103, 105 (i.e. with the fluid encountering the leading edges of the corrugations) is oriented parallel to the direction of gas flow in passages 76 and 78. With the inserts 103, 105 in this orientation there is a relatively low pressure drop in the direction of flow. A low pressure drop orientation is shown in FIG. 14, discussed further below. It will be appreciated that a high pressure drop orientation may be preferred in some embodiments. In a high pressure drop orientation, the fluid encounters the sides of the corrugations.

Where turbulence-enhancing inserts 103, 105 are present in passages 76, 78, they may be provided throughout the entire lengths of passages 76, 78, or they may be provided only in those portions of passages 76, 78 where they will have the most beneficial effect. In this regard, the turbulence-enhancing insert 103 in the downstream tail gas passage 76 will at least be provided in the lower portion of passage 76, below water level 101, to create turbulence in the tail gas in the area of passage 76 where heat is transferred from the tail gas to liquid water in passage 78. The turbulence-enhancing insert 105 in the upstream water/steam passage 78 will at least be provided in the upper portion of passage 78, above water level 101, to create turbulence in the steam in the area of passage 78 where heat is transferred from the tail gas to the steam. It will be appreciated that the structure, orientation and location of the turbulence-enhancing inserts 103, 105 is dictated by a number of factors, including the desired amount of heat transfer and the acceptable amount of pressure drop within boiler 14.

To accommodate differential thermal expansion of tubes 96, 80 and 30, and thereby minimize thermal stresses within boiler 14, the tops and/or bottoms of the corrugations of inserts 103, 105 may be left unbonded from the surfaces of tubes with which they are in contact.

Rather than having turbulence-enhancing inserts 103, 105 in the form of sheets which are inserted into passages 76, 78, one or more of tubes 96, 80 and 30 may be provided with radially-projecting ribs and/or dimples (not shown) which protrude into passage 76 and/or 78 and are arranged to create a tortuous flow path in that passage 76 and/or 78.

The operation of steam generator 10 will now be described with reference to the drawings. As shown in FIG. 1, liquid water enters steam generator 10 through water inlet 102 and collects in the water reservoir in the lower portion of the upstream water/steam passage 78, i.e. that portion of passage 78 located below water level 101. The liquid water in passage 78 is heated by the tail gas flowing downwardly through the downstream tail gas passage 76, the heat being transferred through intermediate tube 80. The heating of the liquid water causes it to be at least partially converted to steam. The steam flows upwardly through passage 78, flowing through steam outlet 106 and entering the manifold space 70 between the first shell 28 and the second shell 66. The steam then flows through the gap 58 and into the downstream steam passage 50 where it is further heated by heat exchange with the tail gas flowing through the hollow interiors of tubes 16. Within passage 50, heat is transferred from the hot tail gas to the steam through the tube walls, thereby superheating the steam. Once the steam passes upwardly through the central opening 113 in first baffle plate 94, and exits the baffle structure through the aperture 97 in the second baffle plate 95, and then exits the steam generator through the superheated steam outlet 54.

Tail gas flows in the opposite direction, i.e. top to bottom in FIG. 1, entering the steam generator 10 through tail gas inlet 24 and exiting steam generator 10 through tail gas outlet 85. The tail gas flowing through inlet 24 enters manifold space 26 and then enters the upstream tail gas passage 22, defined by the hollow interiors of tubes 16. As the tail gas flows downwardly through tubes 16, heat is transferred from the tail gas, through the tube walls, to steam flowing through the downstream steam passage 50. The tail gas then flows out from the second ends 20 of tubes 16 and continues to flow downwardly into manifold space 100, and from there the tail gas enters the downstream tail gas passage 76 where it transfers additional heat to water and steam in the upstream water/steam passage 78. Finally, the cooled tail gas exits passage 76 and flows into manifold space 90 before it is discharged from steam generator 10 through tail gas outlet 85.

Figure 7:
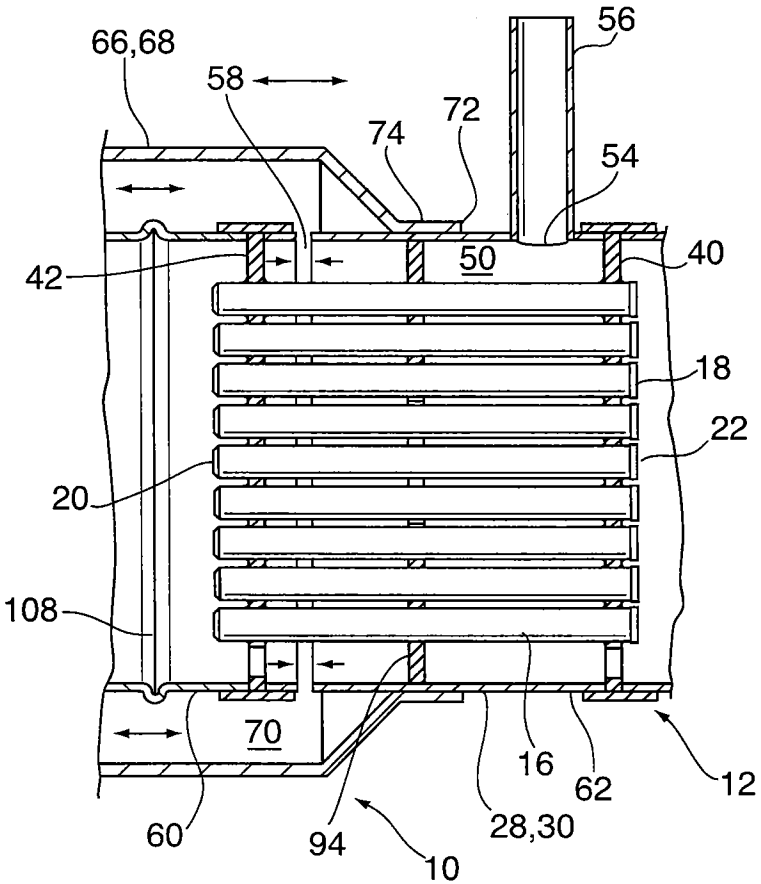
FIGS. 6 and 7 are partial cross-sectional views along line 1-1, illustrating how the heat exchanger of the first embodiment accommodates differential thermal expansion.
Figure 6:
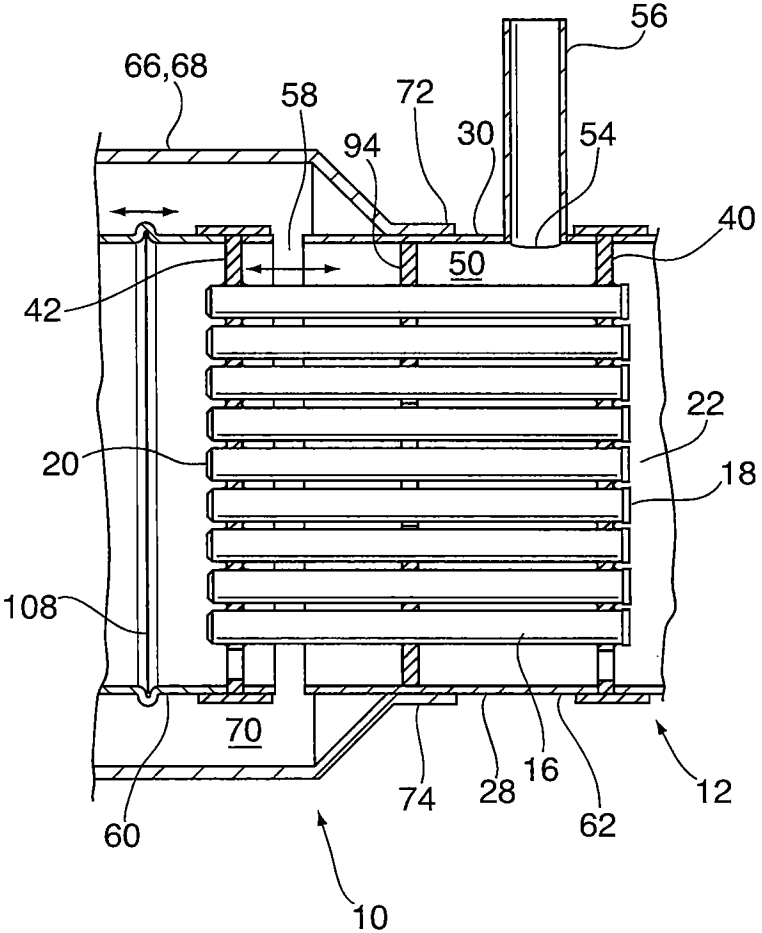
Figure 8:
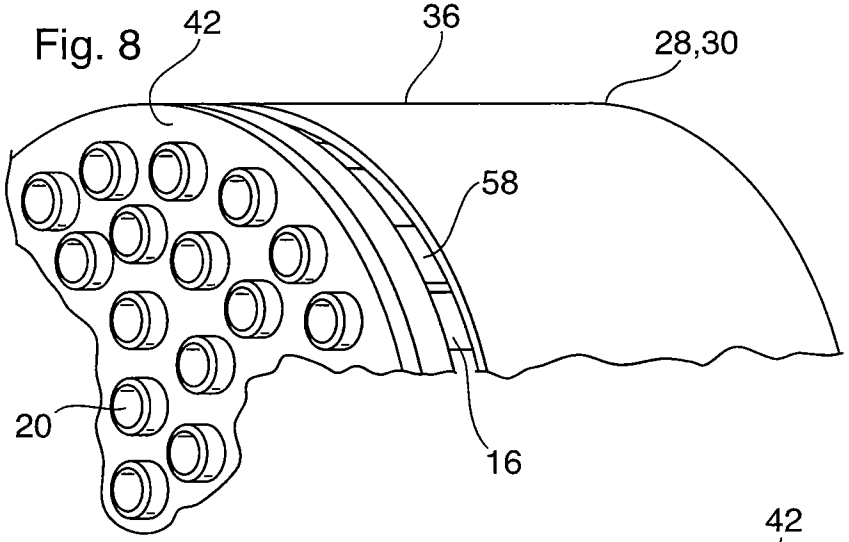
FIGS. 8 and 9 are perspective views showing a portion of the shell in which the tubes are received, again illustrating differential thermal expansion.
Figure 9:
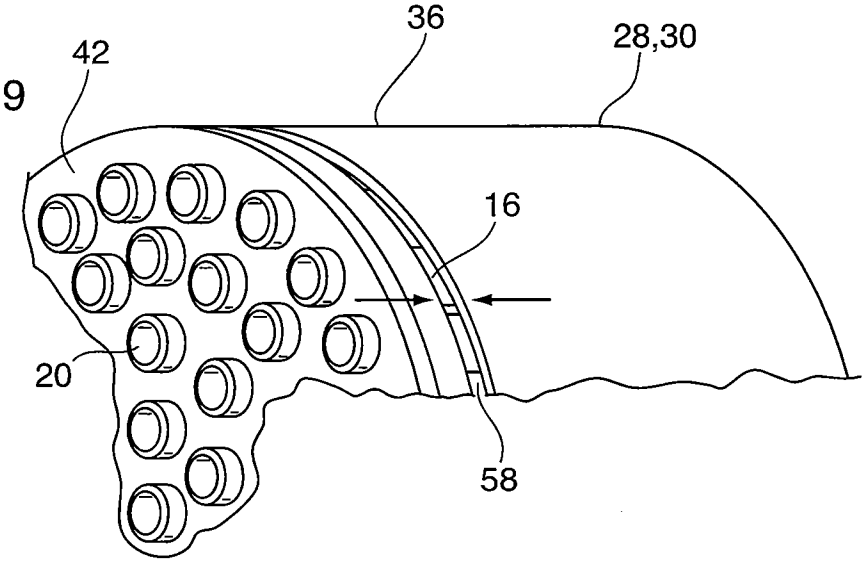

As will be appreciated, the tail gas is considerably hotter than the steam/water and therefore those portions of the steam generator 10 which are in direct contact with the tail gas will generally be at a much higher temperature than those portions of steam generator 10 which are in direct contact with the water/steam. In particular, the tubes 16 are in direct contact with the hot tail gas whereas the portion of first shell 28 defining downstream steam passage 50 is in direct contact with the steam. Thus, the tubes 16 may tend to expand in the axial direction by a greater amount than the first shell 28. As shown in FIG. 6, this differential thermal expansion is taken up by gap 58, wherein gap 58 is made larger (in the axial direction) as the tubes expand when heated, as shown in FIG. 6. Conversely, the gap 58 becomes smaller as the tubes contract when cooled as shown in FIG. 7. This expansion and contraction of gap 58 has the effect of reducing potentially damaging thermal stresses during repeated heating/cooling cycles. Because the second ends 18 of tubes 16 are rigidly secured to the first portion 60 of shell 28 by header 42, the provision of corrugation 108 permits the expansion/contraction of tubes 16 to be taken up by first shell 28, again without causing excessive stresses on the components of steam generator 10.

As will be appreciated, the temperature of the tail gas entering the steam generator 10 is related to the amount and temperature of the steam which will be generated. Where, for example, the tail gas is an exhaust gas from the cathode or anode of a fuel cell, it must undergo an exothermic reaction before it can be used for steam generation. This exothermic reaction may be a catalytic reaction, such as a preferential oxidation for converting carbon monoxide in the tail gas to carbon dioxide, or the exothermic reaction may comprise combustion of molecular hydrogen in the tail gas.

The exothermic reaction may take place upstream of the steam generator 10 or it may take place within the first heat exchanger section 12. The specific steam generator 10 described herein is configured to receive a pre-heated tail gas through inlet 24, i.e. one which has undergone an exothermic reaction upstream of the steam generator 10. However, simple modifications can be made to steam generator 10 to permit the exothermic reaction to take place within the first heat exchanger section 12. For example, where the exothermic reaction is a catalytic reaction such as partial oxidation, a monolithic catalyst may be placed adjacent to tail gas inlet 24 in the inlet manifold space 26, or catalyst-coated structures such as fins may be inserted into the tubes 16. Where the catalytic reaction requires oxygen or air, the tail gas may be combined with oxygen or air upstream of the steam generator 10, or an oxygen or air inlet may be provided in the first heat exchanger section 12, proximate to the tail gas inlet 24.

Although the steam generator 10 described above uses a hot tail gas to generate steam, this is not necessarily the case. Rather, any hot gas stream capable of generating steam can be used in steam generator 10.

A heat exchanger 200 according to a second embodiment of the invention is now described with reference to FIG. 10.

The heat exchanger 200 according to the second embodiment comprises a water gas shift reactor in which a hot synthesis gas (hereinafter "syn gas") is simultaneously cooled and reduced in carbon monoxide content. The water gas shift reactor 200 may be incorporated into a fuel cell system, and may be located downstream of a syn gas generator, such as a fuel reformer, in which the syn gas is produced from a hydrocarbon fuel. The syn gas typically comprises hydrogen, water, carbon monoxide, carbon dioxide and methane. Prior to being used in a fuel cell, the syn gas must be cooled and the carbon monoxide content must be reduced. The syn gas therefore undergoes a slightly exothermic catalytic reaction in the water gas shift reactor 200, converting carbon monoxide and water to carbon dioxide and hydrogen. One or more water gas shift reactors 200 may be required to reduce the carbon monoxide content and/or the temperature of the syn gas to acceptable levels.

The water gas shift reactor 200 generally comprises two heat exchanger sections, a first heat exchanger section 212 comprising a shell and tube heat exchanger, and a second heat exchanger section 214 comprising a shell and tube heat exchanger section. The two heat exchanger sections 212 and 214 are separated by a water gas shift catalyst bed 202 in which the catalytic water gas shift reaction takes place. In the reactor 200, the hot syn gas enters reactor 200 at the right end, through syn gas inlet 24 and syn gas inlet fitting 25, and exits reactor 200 at the left end, through syn gas outlet 85 and syn gas outlet fitting 88.

A coolant, such as air, flows in countercurrent flow relative to the direction of flow of the syn gas. Therefore, the coolant flows from the left to the right in FIG. 10, entering the reactor 200 close to the left end, through coolant inlet 102 and coolant inlet fitting 104, and exiting reactor 200 close to the right end, through coolant outlet 54, and a corresponding coolant outlet fitting (not visible in FIG. 10). The air is heated by the syn gas, and may be used elsewhere in the fuel cell system, such as in a burner in the syn gas generator, or in the cathode of a high temperature fuel cell.

Both the first and second heat exchanger sections 212 and 214 of reactor 200 share many similarities with each other, and with the shell and tube heat exchanger section 12 of the steam generator 10 described above. Accordingly, like components of heat exchanger sections 12, 212, 214 are described using like reference numerals, and the above description of the like components of heat exchanger section 12 applies equally to heat exchanger sections 212, 214.

The shell and tube heat exchangers 212, 214 each include a plurality of axially extending, spaced apart tubes 16 arranged in a tube bundle as in steam generator 10 described above. The tubes 16 are in parallel spaced relation to one another with their ends aligned. Each tube 16 is cylindrical and has a first end 18, a second end 20 and a hollow interior. The first and second ends 18, 20 of tubes 16 are open, with the hollow interiors of the tubes 16 together defining a first fluid flow passage 22 (sometimes referred to herein as "syn gas passage 22"), with the tubes 16 of first heat exchanger section 212 defining a first (upstream) portion 22*a* thereof, and the tubes 16 of second heat exchanger section 214 defining a second (downstream) portion 22*b* thereof. The syn gas enters the reactor 200 through inlet 24, flowing first through the upstream portion 22*a* of syn gas passage 22, then entering the catalyst bed 202 to undergo a water gas shift reaction, and then entering the downstream portion 22*b* of the syn gas passage 22, finally being discharged from the reactor 200 through outlet 85 and fitting 88.

The reactor 200 further comprises a first shell 28 having an axially extending first shell wall 30 extending throughout the length of reactor 200 from syn gas inlet 24 to syn gas outlet 85, surrounding the tubes 16 of both heat exchanger sections 212, 214, and also surrounding the catalyst bed 202.

Each heat exchanger section 212, 214 further comprises a pair of headers, namely a first header 40 located proximate to the first ends 18 of tubes 16, and a second header 42 located proximate to the second ends 20 of tubes 16. The headers 40, 42 are each provided with a plurality of perforations 44 (not shown) in which the respective first and second ends 18, 20 of tubes 16 are received. As shown in FIG. 10, the ends 18, 20 of tubes 16 may extend completely through the perforations of headers 40, 42, and are sealed with and rigidly secured to the headers 40,42 by any convenient means. For example, where the tubes 16 and headers 40,42 are made of metal, they may be secured together by brazing or welding.

Each header 40, 42 has an outer peripheral edge 46 at which it is sealed and secured to the first shell wall 30. It can be seen from the drawings that the first shell wall 30 and the first and second headers 40, 42 together define a second fluid flow passage 50 (sometimes referred to herein as "coolant passage 50"), with a first (upstream) portion 50*a* thereof being defined in the second heat exchanger section 214 and a second (downstream) portion 50*b* thereof being defined in the first heat exchanger section 212. The coolant, which in the present embodiment may comprise air, enters the reactor 200 through coolant inlet 102, successively flows through upstream and downstream passages 50*a*, 50*b* in contact with outer surfaces of the tubes 16, and exits reactor 200 through coolant outlet 54. Although not shown in FIG. 10, the passages 50*a* and 50*b* may each be provided with a baffle arrangement as described above, comprising first and second baffle plates 94 and 95, to create a tortuous path for the coolant, lengthening the flow path and enhancing heat transfer with the syn gas.

The coolant must flow over the outer surface of first shell 28 as it passes from upstream passage 50*a* to downstream passage 50*b*. Therefore, the reactor 200 further comprises a second shell 66 (sometimes referred to herein as the "outer shell 66") having an axially extending second shell wall 68 (sometimes referred to herein as the "outer shell wall 68") which extends along at least a portion of the length of the first shell 28. The outer shell 66 is spaced radially outwardly from the first shell wall 30 to provide an annular coolant flow passage 70 connecting the first and second portions 50*a*, 50*b* of the coolant flow passage 50.

The outer shell 66 is sealed at its ends 72 to the outer surface of the first shell wall 30. In this regard, the outer shell wall 66 is reduced in diameter at each end 72, having inwardly inclined ends, each terminating in an axially extending collar 74 which is sealed to the first shell wall 30 by brazing or welding. As explained above, the inwardly inclined ends are somewhat compliant and accommodate axial expansion and contraction of the second shell wall 66 in response to thermal expansion and contraction in the tubes 16 and the first shell wall 30. In addition, as shown in FIG. 10, the outer shell 66 may be provided with one or more corrugated ribs 204 to accommodate differential thermal expansion of the reactor 200 and to avoid damage caused by thermal stresses. It is also possible to provide corrugated ribs in the section of the first shell wall 30 which surrounds the water gas shift catalyst bed 202 and which is enclosed by the outer shell 66, either in addition to or instead of corrugated ribs 204 in the outer shell 66. The corrugated ribs in the first shell wall would be similar in appearance to those in the outer shell, but would be present only in areas located between the catalyst bed 202 and the ends 20 of tubes 16 in the two heat exchange sections 212, 214.

In order to provide flow communication between annular coolant flow passage 70 and the interiors of the upstream and downstream portions 50*a*, 50*b* of coolant passage 50, each heat exchanger section 212,214 further comprises a slot or gap 58 extending about the entire circumference of the first shell wall 30, and separating the shell wall 30 into a first portion 60, a second portion 62 and a third portion 62'. In reactor 200, the first portion 60 of first shell wall 30 comprises the portion of shell wall 30 between the gap 58 of heat exchanger section 212 and the gap 58 of heat exchanger section 214, to which the baffles 42 are secured. The second portion 62 comprises the portion of shell wall 30 extending to the right of first portion 60, and forming part of the first heat exchanger section 212, while the third portion 62' comprises the portion of shell wall 30 extending to the left of first portion 60, and forming part of the second heat exchanger section 214.

Thus, the first portion 60 of shell wall 30 is axially spaced from the second portion 62 and the third portion 62' of shell wall 30. The gap 58 of heat exchanger section 212 serves as a coolant inlet 52, allowing the coolant to flow from the annular coolant flow passage 70 into the downstream coolant passage 50*b*. The gap 58 of heat exchanger section 214 serves as a coolant outlet, allowing the coolant to flow from the upstream coolant passage 50*a* into the annular coolant flow passage 70.

Figure 10:
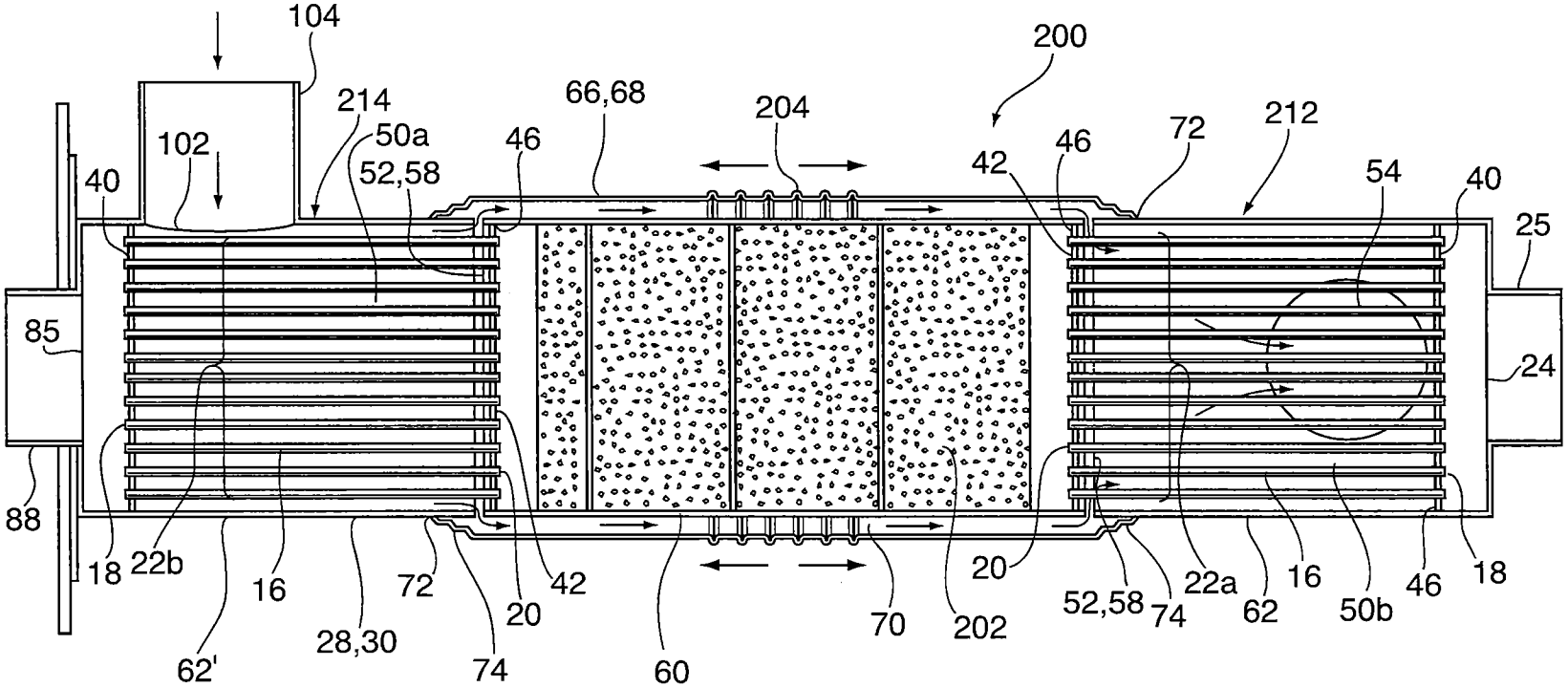
FIG. 10 is an axial cross-section of a heat exchanger according to a second embodiment of the invention.

Although not shown in FIG. 10, the gaps 58 of reactor 200 have the same configuration as shown in FIG. 5, wherein the first shell wall 30 is provided with a plurality of webs 64 extending axially across the gaps 58 in order to provide the first shell wall 30 with a unitary structure. Also, in the assembled reactor 200 shown in FIG. 10, the webs 64 provide a connection between the first portion 60 and the second and third portions 62,62' of the first shell wall 30. It will be appreciated that the webs 64 are of sufficient thickness and rigidity such that they hold the first, second and third portions 60, 62, 62' together to assist in assembly of the reactor 200 during the manufacturing process. However, the webs 64 are sufficiently thin that they do not significantly impair the flow of the second fluid into or out of the first shell 28, and such that they are broken by the forces of axial thermal expansion of the plurality of tubes 16 during use of the steam generator 10.

In use, a hot syn gas which may be at a temperature from 600-1,000 degrees Celsius enters reactor 200 through syn gas inlet 24 and flows from right to left through the upstream portion 22*a* of syn gas passage 22 defined by tubes 16 of first heat exchanger section 212. As it flows through the upstream portion 22*a* of syn gas passage 22, the hot syn gas is partially cooled by heat exchange with a coolant gas, such as air, flowing through the downstream portion 50*b* of the coolant passage 50.

The syn gas flows out from the second ends 20 of tubes 16 and enters the water gas shift catalyst bed 202, where it undergoes a slightly exothermic gas shift reaction to reduce carbon monoxide content and increase hydrogen content. The syn gas then exits the catalyst bed 202 and enters the downstream portion 22*b* of syn gas passage 22 defined by tubes 16 of second heat exchanger section 214. As it flows through the downstream portion 22*b* of syn gas passage 22, the hot syn gas is further cooled by heat exchange with the coolant gas flowing through the upstream portion 50*a* of the coolant passage 50. Finally, the cooled and purified syn gas exits passage 22 and is discharged from reactor 200 through syn gas outlet 85.

The coolant absorbs heat from the syn gas as it successively flows through the first and second portions 50*a*, 50*b* of the coolant passage 50. The coolant flows through the annular passage 70 in order to flow around the catalyst bed 202.

As will be appreciated, the syn gas is considerably hotter than the coolant and therefore those portions of the reactor 200 which are in direct contact with the syn gas will generally be at a much higher temperature than those portions of reactor 200 which are in direct contact with the coolant. In particular, the tubes 16 are in direct contact with the hot syn gas whereas the portions of first shell 28 surrounding and defining upstream and downstream portions 50*a*, 50*b* of coolant passage 50 are in direct contact with the coolant. Thus, the tubes 16 may tend to expand in the axial direction by a greater amount than the first shell 28. In the manner shown in FIG. 6, this differential thermal expansion is taken up by gap 58, wherein gap 58 is made larger (in the axial direction) as the tubes expand when heated. Conversely, the gap 58 becomes smaller as the tubes contract when cooled as shown in FIG. 7. This expansion and contraction of gap 58 has the effect of reducing potentially damaging thermal stresses during repeated heating/cooling cycles. Because the second ends 18 of tubes 16 are rigidly secured to the first portion 60 of shell 28 by headers 42, the provision of corrugations 204 in outer shell 66 permits the expansion/contraction of tubes 16 to be taken up by outer shell 66, without causing excessive stresses on the components of steam generator 10.

Although the steam generator 10 described above comprises a first heat exchanger section 12 comprising a shell and tube heat exchanger having a bundle of thin tubes, and a second heat exchanger section 14 comprising a co-axial, concentric tube heat exchanger, this is not necessarily the case. Some alternate embodiments are now described in which the first heat exchanger section has an alternate configuration.

Figure 11:
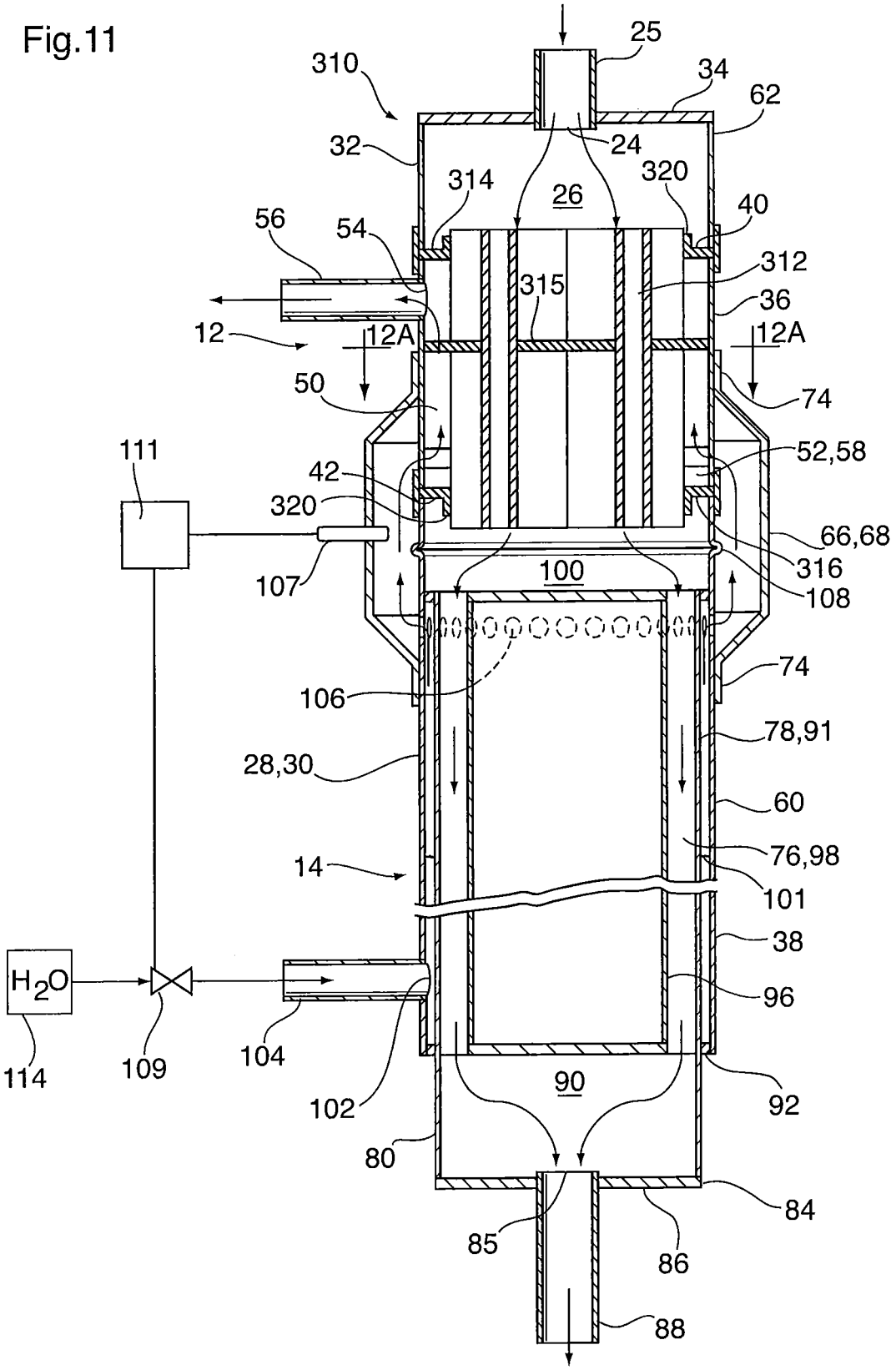
FIG. 11 is an axial cross-section of a steam generator according to a third embodiment of the invention.
Figure 12:
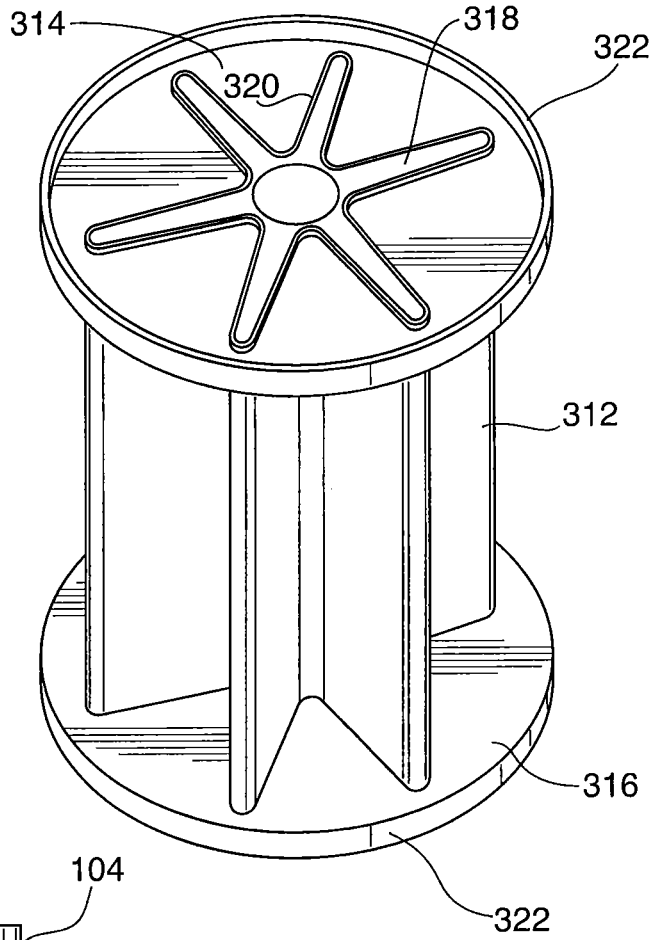
FIG. 12 is an isolated view of the single tube and the two headers of the first heat exchanger section of the steam generator of FIG. 11.
Figure 12A:
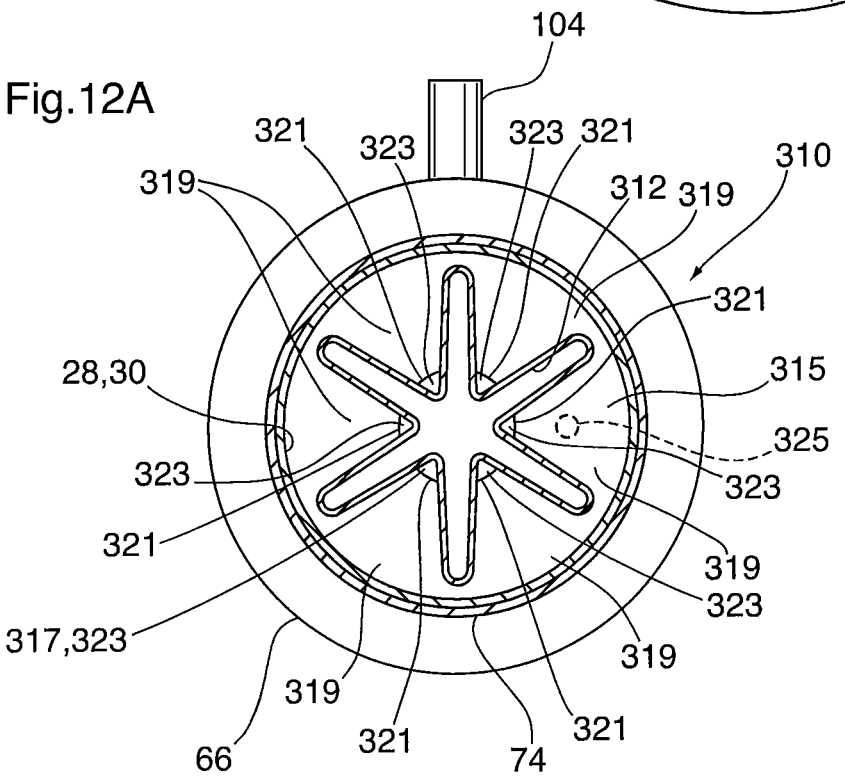
FIG. 12A illustrates a baffle arrangement for the steam generator of FIGS. 11 and 12.

FIGS. 11, 12 and 12A illustrate a steam generator 310 according to an embodiment of the invention, sharing many of the same elements as steam generator 10 described above. These like elements are identified in the drawings by like reference numerals and the above description of these elements applies to the embodiment of FIGS. 11 and 12. The following description is focused on the differences between steam generators 10 and 310.

The steam generator 310 comprises first and second heat exchanger sections 12, 14. The second heat exchanger section 14 of steam generator 310 is a concentric tube heat exchanger which may be identical to that of steam generator 10. The first heat exchanger section 12 of steam generator 310 is of a shell and tube construction, but differs from that of steam generator 10 in that it does not include a tube bundle. Rather, the first heat exchanger section 12 of steam generator 310 comprises a single tube 312 extending axially between a first header 314 and a second header 316. The tube 312 is open at both ends and has a hollow interior surrounded by a tube wall made up of a plurality of corrugations so as to increase the surface area through which heat transfer takes place. The corrugations of tube 312 are relatively few in number and of relatively large amplitude, such that the tube 312 has a star shaped cross section with six lobes, each extending from close to the center of tube 312 to a point which is close to the peripheral edges of the headers 314, 316. However, the configuration of tube 312 shown in FIGS. 11 and 12 is exemplary only, and the tube 312 may be of variable shape. Although a circular area is shown at the center of tube 312, this is not necessary. Rather the inner ends of the corrugations or tubes may meet in the center of tube 312.

The headers 314, 316 have a single aperture 318 conforming to the shape of the tube 312. The aperture 318 may be surrounded by an upstanding collar 320 to provide an improved connection with the wall of tube 312. The outer peripheral edges of headers 314, 316 may be as shown in FIG. 11, joining together segments of the shell 28, or the peripheral edges may simply have an upturned collar 322 to be joined to the inner surface of the shell 28, for example by welding or brazing.

In a similar manner as discussed above with reference to steam generator 10, the hollow interior of tube 312 may be provided with catalyst coated structures such as fins. For example, catalyst-coated fins may be provided in the lobes and a catalyst-coated fin wound into a spiral may be received in the center of the tube 312.

As shown in FIG. 12A, steam generator 310 may also include a baffle plate 315 similar to annular baffle plate 94 described above, having a central opening sized and shaped to receive the tube 312. Where the tube 312 has a star-shaped or corrugated construction as shown in the drawings, the baffle plate will have a star-shaped central opening 317 surrounded by the flat area of baffle plate 315. The flat area will have inwardly-extending lobes 319 to conform to the shape of tube 312. However, the inner tips 321 of at least some of the lobes 319 are cut off to create gaps 323 between the baffle plate 315 and the tube 312, the gaps 323 being located as close as possible to the center of heat exchanger section 12, so as to create a tortuous flow path through section 12. It will also be appreciated that the flat area of baffle plate 315 may be provided with holes 325 through which there will be some fluid flow. Only one hole 325 is shown in dotted lines in FIG. 12A, but it will be appreciated that the number, size and location of these holes 325 will depend upon the desired flow characteristics within section 12.

Figure 13:
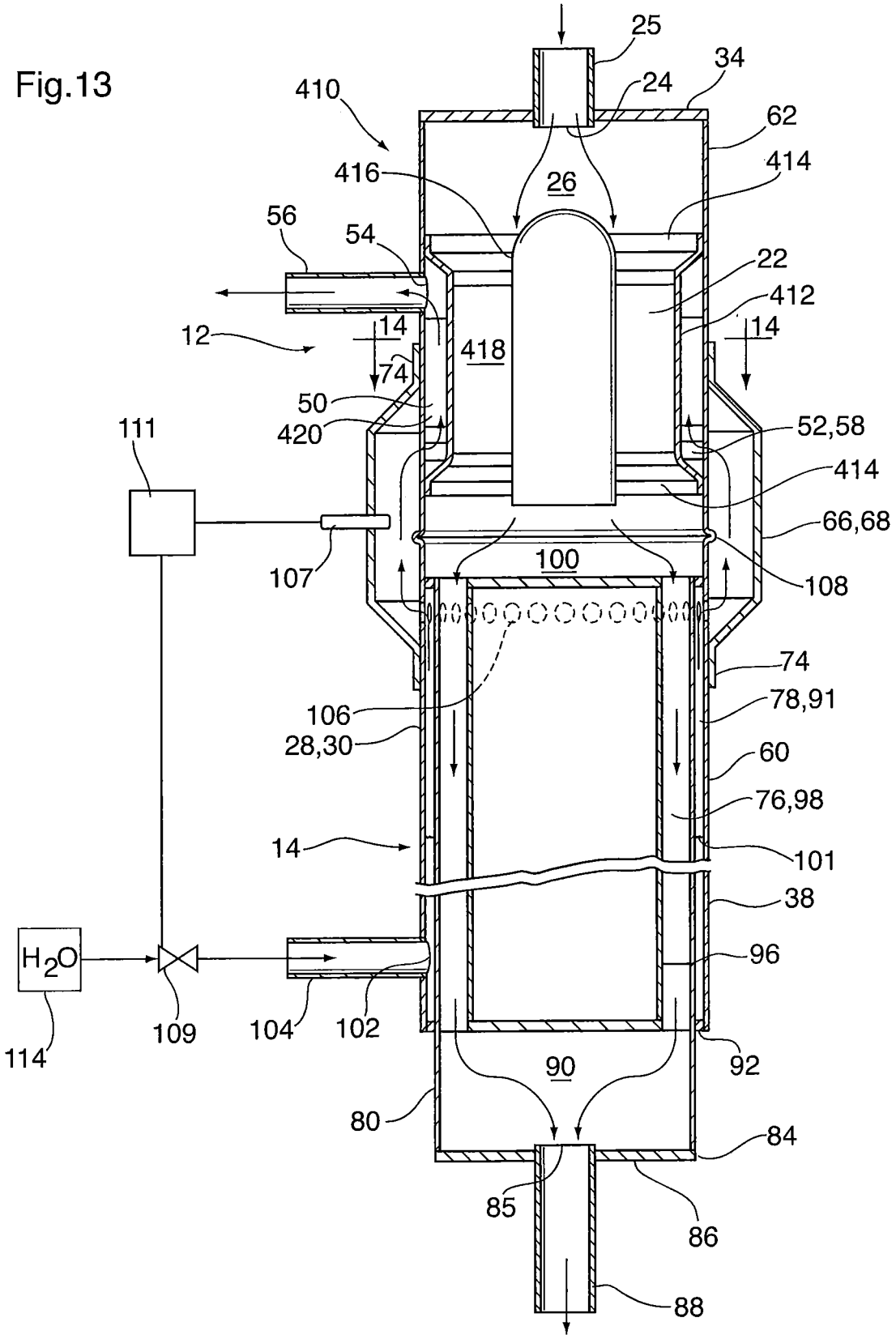
FIG. 13 is an axial cross-section of a steam generator according to a fourth embodiment of the invention.
Figure 15:
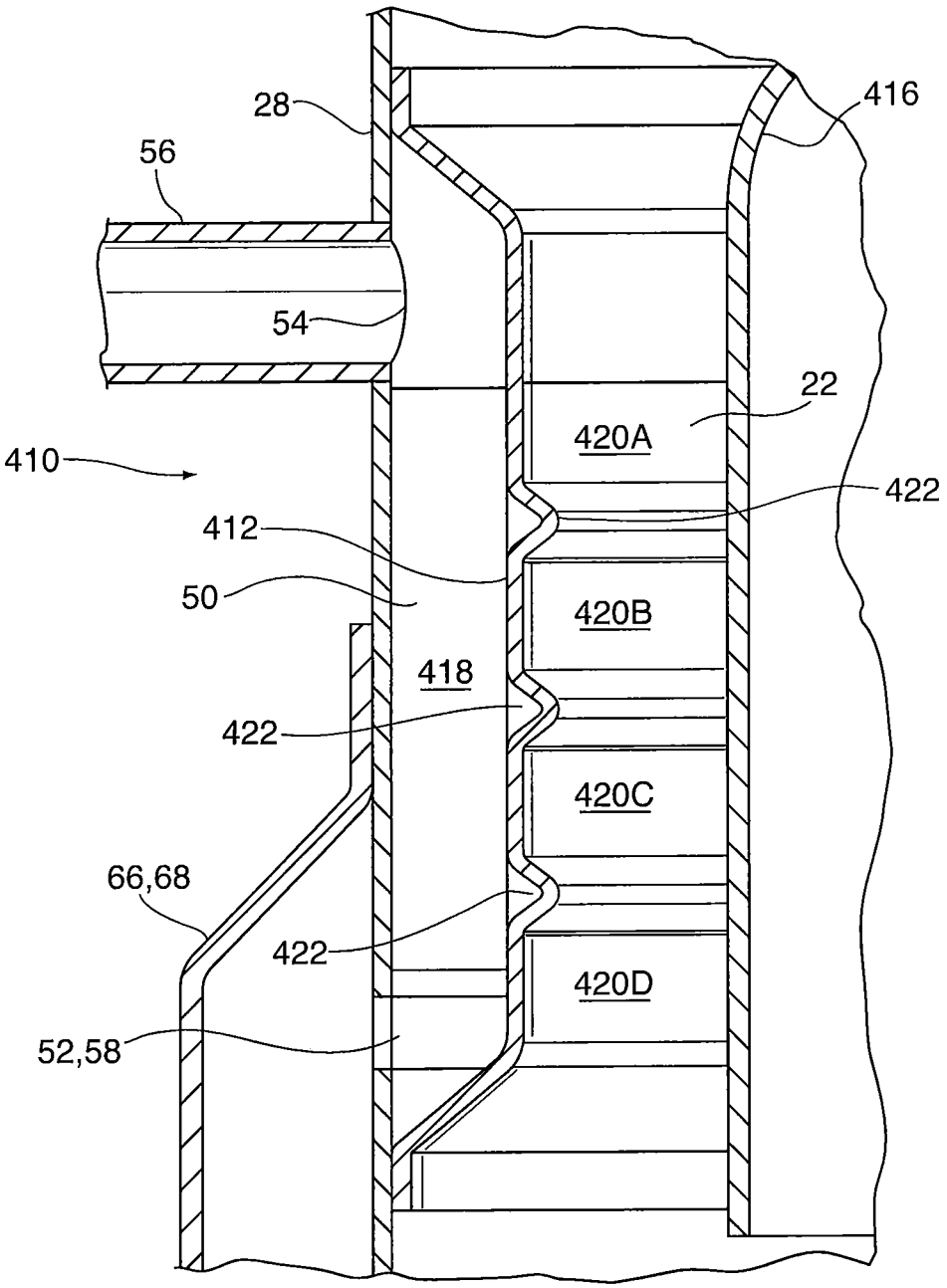
FIG. 15 is an enlarged, partial axial cross-section of a variant of the steam generator of FIG. 13.

FIGS. 13 to 15 illustrate a steam generator 410 according to an embodiment of the invention, sharing many of the same elements as steam generator 10 described above. These like elements are identified in the drawings by like reference numerals and the above description of these elements applies to the embodiment of FIGS. 13 to 15. The following description is focused on the differences between steam generators 10 and 410.

The steam generator 410 comprises first and second heat exchanger sections 12, 14. The second heat exchanger section 14 of steam generator 410 is a concentric tube heat exchanger which may be identical to that of steam generator 10. The first heat exchanger section 12 of steam generator 410 differs from that of steam generator 10 in that it does not have a shell and tube construction, nor does it include headers. Rather, the first heat exchanger section 12 of steam generator 410 comprises a concentric tube heat exchanger having an intermediate, axially extending tube 412 which is expanded at its ends and provided with collars 414 which are secured to the inside of the inner shell 28, such that the downstream passage 22 is provided in an outer annular space between the inner shell 28 and the intermediate tube 412, and the downstream steam passage 50 is sealed by the expanded ends of the intermediate tube 412.

The first heat exchanger section further comprises an axially extending inner tube 416, which is a "blind tube" closed at one or both of its ends, and is received within the intermediate tube 412 wherein the upstream tail gas passage 22 is defined within an inner annular space between the inner tube 416 and the intermediate tube 412. The inner annular space is open at its ends to permit flow therethrough of the tail gas.

To optimize heat transfer, one or both of the upstream tail gas passage 22 and the downstream steam passage 50 may be provided with turbulence-enhancing inserts in the form of corrugated fins or turbulizers as described above. The turbulence-enhancing insert in the upstream tail gas passage 22 is identified by reference numeral 418 in FIGS. 13 and 14, and the turbulence-enhancing insert in the downstream steam passage 50 is identified by reference numeral 420. The turbulence-enhancing inserts 418, 420 shown in FIG. 14 are in a low pressure drop orientation, however it will be appreciated that passages 22 and 50 may instead be provided with turbulence-enhancing inserts having a high pressure drop orientation.

In order to support the inner tube 416 and enhance heat transfer between the steam and tail gas, the fin 418 in the upstream tail gas passage 22 may be bonded to both the inner tube 416 and the intermediate tube 412, for example by brazing. Also for the purpose of enhancing heat transfer, the fin 420 in the downstream steam passage 50 may be bonded to the intermediate tube 412, for example by brazing. However, for the purpose of accommodating differential thermal expansion of shell 28 and intermediate tube 412, and to reduce unwanted heat loss through the shell 28, fin 420 may be left unbonded to the shell 28.

In cases where additional accommodation of differential thermal expansion is desired, the intermediate tube 412 may be provided with circumferentially extending corrugations 422. Since the corrugations 422 protrude into the upstream tail gas passage 22, the fin 420 may be broken up into segments 420A, 420B, 420C and 420D, separated by corrugations 422. The corrugations 422 provide the intermediate tube 412 with compliance, and render it somewhat more compliant than fin 418 to which it is bonded. Thus, the corrugations 422 permit the intermediate tube 412 to absorb axially directed forces of thermal expansion, to avoid stress and damage to surrounding components of the heat exchanger.

Although the invention has been described by reference to certain embodiments, it is not limited thereto. Rather, the invention includes all embodiments which may fall within the scope of the following claims.

What is claimed is:

1. A heat exchange device comprising a first heat exchanger section and a second heat exchanger section arranged in series, wherein the heat exchange device comprises:

(a) an inner shell having a first end and a second end, and having an inner shell wall extending along an axis between the first and second ends, wherein the first heat exchanger section and the second heat exchanger section are enclosed within the inner shell wall;

(b) a first fluid inlet provided in the first heat exchanger section and a first fluid outlet provided in the second heat exchanger section;

(c) a second fluid inlet provided in the second heat exchanger section and a second fluid outlet provided in the first heat exchanger section;

(d) an axially-extending first fluid flow passage extending through both the first and second heat exchanger sections from the first fluid inlet to the first fluid outlet, wherein the first fluid flows between the first and second heat exchanger sections through an internal connecting passage located inside the inner shell;

(e) an axially-extending second fluid flow passage extending through both the first and second heat exchanger sections from the second fluid inlet to the second fluid outlet, wherein the first and second fluid flow passages are sealed from one another, and wherein the second fluid flows between the second and first heat exchanger sections through an external connecting passage located outside the inner shell;

(f) an outer shell enclosing the external connecting passage;

(g) at least one aperture through the inner shell in the second heat exchanger section through which the second fluid flows from the second heat exchanger section into the external connecting passage;

(h) at least one aperture through the inner shell in the first heat exchanger section through which the second fluid flows from the external connecting passage into the first heat exchanger section;

wherein said at least one aperture in the first heat exchanger section comprises a first axial gap which is provided between a first portion of the inner shell wall and a second portion of the inner shell wall;

wherein the second heat exchanger section comprises a concentric tube heat exchanger comprising:

(i) an axially extending intermediate tube which is at least partially received within the first portion of the inner shell wall and is spaced therefrom so that an outer annular space is provided between the inner shell wall and the intermediate tube, wherein the outer annular space comprises part of the second fluid flow passage and is located between the second fluid inlet and the at least one aperture through the inner shell in the second heat exchanger section through which the second fluid flows from the second heat exchanger section into the external connecting passage;

(ii) an axially extending inner tube received within the intermediate tube and spaced therefrom so that an inner annular space is provided between the inner tube and the intermediate tube, wherein the inner annular space comprises part of the first fluid flow passage, and is located between the internal connecting passage and the first fluid outlet, and wherein at least one end of the inner tube is closed in order to prevent fluid flow therethrough;

wherein the first heat exchanger section comprises a shell and tube heat exchanger, comprising:

(a) a first plurality of axially extending, spaced apart tubes enclosed within the inner shell, each of the tubes of the first plurality having a first end, a second end and a hollow interior, the first and second ends being open; wherein the hollow interiors of the first plurality of tubes together define part of the first fluid flow passage;

(b) a first header having perforations in which the first ends of the first plurality of tubes are received in sealed engagement, wherein the first header has an outer peripheral edge which is sealingly secured to the inner shell wall;

(c) a second header having perforations in which the second ends of the first plurality of tubes are received in sealed engagement, wherein the second header has an outer peripheral edge which is sealingly secured to the inner shell wall, wherein a space enclosed by the inner shell and the first and second headers defines part of the second fluid flow passage;

wherein the first header is attached to the first portion of the inner shell and the second header is attached to the second portion of the inner shell, such that the first axial gap between the first and second portions of the inner shell wall provides communication between the external connecting passage and the space enclosed by the inner shell and the first and second headers;

wherein the second fluid outlet comprises an aperture through the inner shell wall and is located between the first header and the second header, wherein the first header and the second fluid outlet are located proximate to the first end of the inner shell;

wherein the first heat exchanger section further comprises a first baffle plate extending across the space enclosed by the inner shell and the first and second headers and dividing said space into a first portion and a second portion;

wherein the first baffle plate has an outer peripheral edge which is close to or in contact with the inner shell wall, a plurality of perforations through which the first plurality of tubes extend, and an aperture which provides communication between the first and second portions of said space;

wherein the outer peripheral edge of the first baffle plate is sealingly secured to the inner shell wall;

wherein the second fluid outlet is located in the first portion of said space;

wherein the first heat exchanger section further comprises a second baffle plate having an axially extending tubular side wall having a hollow interior and which is open at both ends;

wherein the second baffle plate is located within the first portion of said space and extends axially between the first baffle plate and the first header;

wherein one end of the second baffle plate abuts the first baffle plate with the tubular side wall of the second baffle plate surrounding the aperture of the first baffle plate such that the aperture of the first baffle plate communicates with the hollow interior of the tubular side wall of the second baffle plate; and wherein the tubular side wall of the second baffle plate has at least one aperture providing communication between the hollow interior of the second baffle plate and the second fluid outlet.

2. The heat exchange device of claim 1, wherein the first baffle plate is a flat, annular plate and extends transversely across the space enclosed by the inner shell and the first and second headers, wherein the aperture through the first baffle plate is located in a central portion of the first baffle plate, and wherein the first baffle plate is located approximately midway between the first and second headers.

3. The heat exchange device of claim 1, wherein the at least one aperture in the tubular side wall of the second baffle plate faces away from the aperture defining the second fluid outlet.

4. The heat exchange device of claim 3, wherein the aperture in the tubular side wall of the second baffle plate comprises an axially extending slot.

* * * * *